US008125392B2

(12) United States Patent
Furuya et al.

(10) Patent No.: US 8,125,392 B2
(45) Date of Patent: Feb. 28, 2012

(54) ANTENNA AND ELECTRONIC APPARATUS

(75) Inventors: Hirotaka Furuya, Chiba (JP); Ning Guan, Chiba (JP)

(73) Assignee: Fujikura Ltd., Tokyo (JP)

( * ) Notice: Subject to any disclaimer, the term of this patent is extended or adjusted under 35 U.S.C. 154(b) by 380 days.

(21) Appl. No.: 12/439,611

(22) PCT Filed: Aug. 28, 2007

(86) PCT No.: PCT/JP2007/066664

§ 371 (c)(1),
(2), (4) Date: Mar. 2, 2009

(87) PCT Pub. No.: WO2008/026587

PCT Pub. Date: Mar. 6, 2008

(65) Prior Publication Data

US 2009/0273524 A1 Nov. 5, 2009

(30) Foreign Application Priority Data

Sep. 1, 2006 (JP) ..... 2006-237352

(51) Int. Cl.
*H01Q 1/38* (2006.01)

(52) U.S. Cl. ..... 343/700 MS; 343/767; 343/770

(58) Field of Classification Search ..... 343/700 MS, 343/767, 770

See application file for complete search history.

(56) References Cited

U.S. PATENT DOCUMENTS

| | | | | |
|---|---|---|---|---|
| 7,006,048 | B2 * | 2/2006 | Chang | 343/767 |
| 7,088,301 | B2 * | 8/2006 | Louzir et al. | 343/767 |
| 7,248,220 | B2 * | 7/2007 | Futamata | 343/700 MS |
| 7,405,664 | B2 * | 7/2008 | Sakama et al. | 340/572.7 |
| 7,808,437 | B2 * | 10/2010 | Ying | 343/702 |
| 2002/0135525 | A1 | 9/2002 | Ikegaya et al. | |
| 2003/0184484 | A1 | 10/2003 | Ikegaya et al. | |
| 2004/0008146 | A1 | 1/2004 | Ikegaya et al. | |
| 2004/0239575 | A1 | 12/2004 | Shoji et al. | |
| 2006/0119517 | A1 | 6/2006 | Futamata | |

FOREIGN PATENT DOCUMENTS

| | | | |
|---|---|---|---|
| JP | 7-111418 | A | 4/1995 |
| JP | 2003-37431 | A | 2/2003 |
| JP | 3656610 | B2 | 3/2005 |
| JP | 3690375 | B2 | 6/2005 |
| JP | 2005-277897 | A | 10/2005 |
| JP | 2006-42254 | A | 2/2006 |
| JP | 3840469 | B2 | 8/2006 |
| JP | 3844717 | B2 | 8/2006 |
| WO | 2004/054035 | A1 | 6/2004 |

OTHER PUBLICATIONS

Morihiko Ikegaya, et al. "Built-in Film Antenna for Mobile Devices using 2.4. GHz Band,—Development of 2.4 GHz Film Type Antenna for Mobile Devices—", "Hitachi Densen", Technical Journal of Hitachi Cable, Ltd., Jan. 2002, pp. 35-40 with English Abstract.

* cited by examiner

*Primary Examiner* — Tho G Phan

(74) *Attorney, Agent, or Firm* — Sughrue Mion, PLLC

(57) ABSTRACT

An antenna 1 includes: a plate-like base 3 made of an insulating material; and a conductor 5 in a predetermined shape, which has multiple cut-out portions 10, 13, 15 and which is provided at a predetermined position of the base 3 to obtain predetermined antenna characteristics. The antenna 1 is configured so that the antenna characteristics can be mostly maintained even when the base 3 is deformed into a predetermined curved-surface shape.

4 Claims, 36 Drawing Sheets

(a)

(b)

(a)

(b)

RADIATION CHARACTERISTIC OF xy PLANE (Unit:dBi)

(a)

(b)

(c)

(d)

RADIATION CHARACTERISTIC OF yz PLANE (Unit:dBi)

(a)

(b)

(c)

(d)

RADIATION CHARACTERISTIC OF zx PLANE (Unit:dBi)

(a)

(b)

(c)

(d)

RELATIONSHIP BETWEEN R AND AVERAGE GAIN

VSWR CHARACTERISTIC

RADIATION CHARACTERISTIC (xy PLANE Unit:dBi)

RADIATION CHARACTERISTIC (yz PLANE Unit:dBi)

RADIATION CHARACTERISTIC (zx PLANE Unit:dBi)

(a)

RELATIONSHIP BETWEEN R AND VSWR (b)

RELATIONSHIP BETWEEN R AND VSWR

FIG. 14

AVERAGE GAIN (Unit:dBi)

| | xy | yz | zx |
|---|---|---|---|
| ANTENNA 1 (FIG. 1) | -2.08 | -3.22 | -4.76 |
| ANTENNA 1a (FIG. 8) | -2.79 | -3.61 | -5.91 |

(a)

(b)

RADIATION CHARACTERISTIC OF xy PLANE (S=0 ; Unit:dBi)

RADIATION CHARACTERISTIC OF xy PLANE (S=16 ; Unit:dBi)

FIG. 21

AVERAGE GAIN (Unit:dBi)

| α | s=0mm | s=16mm |
|---|---|---|
| 0° | -1.8 | -2.8 |
| 45° | -2.4 | -2.1 |
| 90° | -2.1 | -1.6 |
| 135° | -4.9 | -2.0 |

FIG. 22

AVERAGE GAIN

| R | GAIN (dBi) |
|---|---|
| 10 | -5.7 |
| 20 | -2.9 |
| 30 | -3.5 |
| 40 | -3.3 |
| infinite | -3.1 |

RADIATION CHARACTERISTIC OF xy PLANE (Unit:dBi)

(a)

(b)

ANTENNA AND ELECTRONIC APPARATUS

TECHNICAL FIELD

The present invention relates to an antenna and an electronic apparatus in which the antenna is mounted, and particularly relates to an antenna used in an apparatus such as a personal computer to construct a wireless LAN or the like.

BACKGROUND ART

In recent years, radio communication systems (wireless LAN) have been widely used and "HotSpots" have been increased at which mobile devices supporting this wireless LAN, for example, notebook personal computers can be connected to the Internet or other services in the public areas. As a plate-like antenna mountable in the notebook personal computer capable of using the wireless LAN at the HotSpot, a flat-plane antenna formed of a plate-like metal element has been known (for example, see Non-patent Document 1).

The metal element of the antenna is formed by a rectangular plate-like ground conductor and an "L" shaped radiation conductor extending in a long narrow form from the end portion of the ground conductor. The frequency used by the antenna is about 2.4 GHz and the radiation conductor extends by a length corresponding to about ¼ of a wavelength λ of the used frequency.

An inner conductor (center conductor) of a coaxial cable is electrically connected to the radiation conductor, and an outer conductor of the coaxial cable is electrically connected to the ground conductor.

Then, the antenna is designed to be supplied with power by using the coaxial cable.

[Non-patent Document 1] "Built-in Film Antenna for Mobile Devices using 2.4. GHz Band," Technical Journal of Hitachi Cable, Ltd., No. 21 issued in January, 2002). Meanwhile, an antenna is known which is configured to be entirely flexible by forming a conductor thinly on a surface of a film-like base (for example, see Patent Document 1).

[Patent Document 1] Japanese Patent Application Publication No. 2005-277897).

DISCLOSURE OF THE INVENTION

Recent further miniaturization and the like of personal computers (particularly, mobile personal computers) have reduced an antenna mounting space, and further miniaturization of the antenna has been demanded. Nevertheless, in the conventional antenna using the metal element, the ground conductor is required to have a certain large size so as to maintain antenna characteristics (frequency characteristic and directivity) in a good condition. This makes it difficult to miniaturize the antenna.

Therefore, there is a problem that the conventional antenna using the metal element cannot sufficiently achieve the object of reducing the mounting space while maintaining the antenna characteristics (frequency characteristic and directivity).

Additionally, in the conventional flexible antenna, the antenna can be, for example, inserted from a narrow space by being bent or somehow when being mounted. Meanwhile, there is a problem that, when the antenna is mounted while being bent, the antenna characteristics are changed, so that the antenna cannot be used sometimes.

The present invention has been made in view of the aforementioned problem. An object of the present invention is to provide an antenna which is mounted while being bent, and thereby which allows a mounting space to be made smaller than that of the conventional antenna, and to provide an electronic apparatus on which the antenna is mounted.

An invention according to a first aspect of the present invention is an antenna comprising: a plate-like base made of an insulating material; and a conductor in a predetermined shape, the conductor having a plurality of cut-out portions and being provided at a predetermined position of the base so as to obtain a predetermined antenna characteristic, wherein the antenna is configured to maintain the antenna characteristic mostly even when the base is deformed into a predetermined curved-surface shape or the base is bent along a predetermined straight line.

An invention according to a second aspect of the present invention is an antenna comprising: a plate-like base made of an insulating material and having flexibility; a first conductor formed into an approximately rectangular outer shape, and provided on a surface of the base, the first conductor having a first cut-out portion and a second cut-out portion; a second conductor having a first element and a second element provided so as to connect the first element and the first conductor to each other, the first element being formed in a long narrow rectangular shape with approximately the same length as that of the first conductor, the first element being provided on the base a predetermined distance away from the first conductor, at a side of one end portion of the first conductor in a width direction, in such a way that a longitudinal direction of the first element is aligned with a longitudinal direction of the first conductor, the second element having a short rectangular shape, and being provided on the surface of the base so as to extend from one end portion of the first element in a longitudinal direction toward a vicinity thereof between the first element and the first conductor; and a coaxial cable whose outer conductor is electrically connected to a first predetermined portion of the first conductor and whose inner conductor is electrically connected to a second predetermined portion of the second conductor; wherein the first predetermined portion where the outer conductor of the coaxial cable is connected extends from the one end portion of the first conductor in the width direction to a vicinity thereof, at the side of the one end portion of the first conductor in the longitudinal direction thereof; the second predetermined portion where the inner conductor of the coaxial cable is connected extends in the width direction of the first element, at a side of the one end portion of the first element of the second conductor in the longitudinal direction; the first cut-out portion is formed into a long narrow rectangular shape with approximately the same width as that of the first element of the second conductor, and extends to an approximately center portion of the first conductor from the other end portion of the first conductor in the longitudinal direction, at the side of the one end portion of the first conductor in the width direction, in such a way that a longitudinal direction of the first cut-out portion is aligned with the longitudinal direction of the first conductor; and the second cut-out portion is formed into a long narrow rectangular shape with approximately the same width as that of the first element of the second conductor, and extends to an approximately center portion of the first conductor from the one end portion of the first conductor in the longitudinal direction, at a side of the other end portion of the first conductor in the width direction in such a way that a longitudinal direction of the second cut-out portion is aligned with the longitudinal direction of the first conductor; or alternatively, wherein the first cut-out portion is formed into a long narrow rectangular shape with approximately the same width as that of the first element of the second conductor, and extends to an approximately center portion of the first conductor from the one end portion of the first conductor in the longitudinal direction, at the side of the one end portion of the first conductor in the width direction, in such a way that the longitudinal direction of the first cut-out portion is aligned with the longitudinal direction of the first conductor; and the second cut-out portion is formed into a long narrow rectangular shape with approximately the same width as that of the first element of the second conductor, and extends to an approximately center portion of the first conductor from the other end portion of the first conductor in the longitudinal direction, at a side of the other end portion of the first conductor in the width direction in such a way that the longitudinal direction of the second cut-out portion is aligned with the longitudinal direction of the first conductor.

An invention according to a third aspect of the present invention is An antenna comprising: a plate-like base made of an insulating material and having flexibility; a first conductor formed into an approximately rectangular outer shape, and provided on a surface of the base, the first conductor having a first cut-out portion and a second cut-out portion; a second conductor having a first element and a second element provided so as to connect the first element and the first conductor to each other, the first element being formed in a long narrow rectangular shape with approximately the same length as that of the first conductor, the first element being provided on the base a predetermined distance away from the first conductor, at a side of one end portion of the first conductor in a width direction, in such a way that a longitudinal direction of the first element is aligned with a longitudinal direction of the first conductor, the second element having a short rectangular shape, and being provided on the surface of the base so as to extend from one end portion of the first element in a longitudinal direction toward a vicinity thereof between the first element and the first conductor; and a coaxial cable whose outer conductor is electrically connected to a first predetermined portion of the first conductor and whose inner conductor is electrically connected to a second predetermined portion of the second conductor; wherein the first predetermined portion where the outer conductor of the coaxial cable is connected extends from the one end portion of the first conductor in the longitudinal direction thereof to a vicinity thereof, at the side of the one end portion of the first conductor in the longitudinal direction thereof; the second predetermined portion where the inner conductor of the coaxial cable is connected extends in a width direction of the first element, at a side of the one end portion of the first element of the second conductor in the longitudinal direction of the first element; the first cut-out portion is formed into a long narrow rectangular shape with approximately the same width as that of the first element of the second conductor, and extends to a portion on the side of the one end portion of the first conductor in the longitudinal direction from the other end portion of the first conductor in the longitudinal direction, at the side of the one end portion of the first conductor in the width direction, in such a way that the longitudinal direction of the first cut-out portion is aligned with the longitudinal direction of the first conductor; and the second cut-out portion is formed into a long narrow rectangular shape with approximately the same width as that of the first element of the second conductor, and extends to a portion on the side of the other end portion of the first conductor in the longitudinal direction from the one end portion of the first conductor in the longitudinal direction, at a side of the other end portion of the first conductor in the width direction in such a way that the longitudinal direction of the second cut-out portion is aligned with the longitudinal direction of the first conductor.

An invention according to a fourth aspect of the present invention is an antenna comprising: a plate-like base made of an insulating material and having flexibility; a first conductor formed into an approximately rectangular outer shape, and provided on a surface of the base, the first conductor having a first cut-out portion and a second cut-out portion; a second conductor having a first element and a second element provided so as to connect the first element and the first conductor to each other, the first element being formed in a long narrow rectangular shape with approximately the same length as that of the first conductor, the first element being provided on the base a predetermined distance away from the first conductor, at a side of one end portion of the first conductor in a width direction, in such a way that a longitudinal direction of the first element is aligned with a longitudinal direction of the first conductor, the second element having a short rectangular shape, and being provided on the surface of the base so as to extend from one end portion of the first element in a longitudinal direction toward a vicinity thereof between the first element and the first conductor; a first connection section formed into a rectangular shape, and provided on the surface of the base to be connected to the first element, the first connection section being located, in the width direction of the first conductor, at the side of the first element of the second conductor between the first conductor and the first element, and being located, in the longitudinal direction of the first conductor, at the side of the second element of the second conductor; a second connection section formed into a rectangular shape, and provided on the surface of the base to be connected to the first conductor, the second connection section being located, in the width direction of the first conductor, at the side of the first conductor between the first conductor and the first element of the second conductor, and being located, in the longitudinal direction of the first conductor, between the first connection section and the second element of the second conductor; and a coaxial cable whose inner conductor is electrically connected to the first connection section and whose outer conductor is electrically connected to the second connection section; wherein the first cut-out portion is formed into a long narrow rectangular shape with approximately the same width as that of the first element of the second conductor, and extends to a portion on the side of the one end portion of the first conductor in the longitudinal direction from the other end portion of the first conductor in the longitudinal direction, at the side of the one end portion of the first conductor in the width direction, in such a way that the longitudinal direction of the first cut-out portion is aligned with the longitudinal direction of the first conductor; and the second cut-out portion is formed into a long narrow rectangular shape with approximately the same width as that of the first element of the second conductor, and extends to a portion on the side of the other end portion of the first conductor in the longitudinal direction from the one end portion of the first conductor in the longitudinal direction, at a side of the other end portion of the first conductor in the width direction in such a way that the longitudinal direction of the second cut-out portion is aligned with the longitudinal direction of the first conductor.

An invention according to a fifth aspect of the present invention is an antenna comprising: a plate-like base made of an insulating material and having flexibility; a first conductor formed into an approximately rectangular outer shape, and provided on a surface of the base, the first conductor having a first cut-out portion and a second cut-out portion; a second conductor having a first element and a second element provided so as to connect the first element and the first conductor to each other, the first element being formed in a long narrow rectangular shape with approximately the same length as that of the first conductor, the first element being provided on the base a predetermined distance away from the first conductor, at a side of one end portion of the first conductor in a width direction, in such a way that a longitudinal direction of the first element is aligned with a longitudinal direction of the first conductor, the second element having a short rectangular shape, and being provided on the surface of the base so as to extend from one end portion of the first element in a longitudinal direction toward a vicinity thereof between the first element and the first conductor; and a coaxial cable whose inner conductor is electrically connected to a first predetermined portion of the first conductor and whose outer conductor is electrically connected to a second predetermined portion of the second conductor; wherein the first predetermined portion where the inner conductor of the coaxial cable is connected is located at a side of the one end portion of the first conductor in the width direction and at a side of the one end portion of the first conductor in the longitudinal direction; the second predetermined portion where the outer conductor of the coaxial cable is connected is located between the first predetermined portion and the second element of the second conductor, at a side of the one end portion of the first element of the second conductor in the longitudinal direction; the first cut-out portion is formed into a long narrow rectangular shape with approximately the same width as that of the first element of the second conductor, and extends to a portion on the side of the one end portion of the first conductor in the longitudinal direction from the other end portion of the first conductor in the longitudinal direction, at the side of the one end portion of the first conductor in the width direction, in such a way that the longitudinal direction of the first cut-out portion is aligned with the longitudinal direction of the first conductor; and the second cut-out portion is formed into a long narrow rectangular shape with approximately the same width as that of the first element of the second conductor, and extends to a portion on the side of the other end portion of the first conductor in the longitudinal direction from the one end portion of the first conductor in the longitudinal direction, at a side of the other end portion of the first conductor in the width direction in such a way that the longitudinal direction of the second cut-out portion is aligned with the longitudinal direction of the first conductor.

An invention according to a sixth aspect of the present invention is an electronic apparatus comprising the antenna according to any one of the first to fifth aspects of the present invention.

BRIEF DESCRIPTION OF THE DRAWINGS

FIG. 14 is a view illustrating an average gain at the time when each antenna is mounted in a plane shape.

FIG. 21 illustrates an average gain in each of the distance S and an angle $\alpha$ in the antenna.

FIG. 22 is a view illustrating an average gain at the time when the antenna is deformed into a cylinder side surface shape and showing a gain based on a bending radius R.

BEST MODES FOR CARRYING OUT THE INVENTION

First Embodiment

Figure 1:
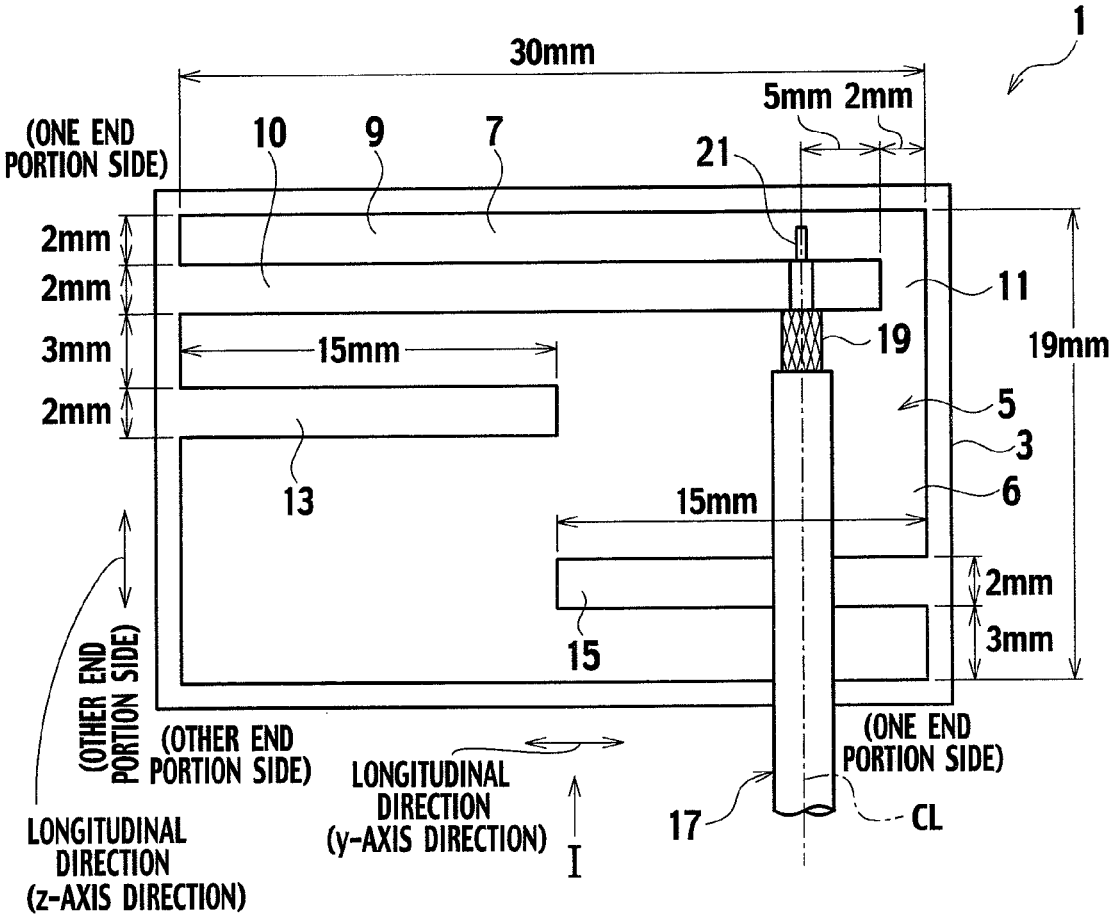
FIG. 1 is a view illustrating a schematic configuration of an antenna according to a first embodiment of the present invention.
Figure 1:
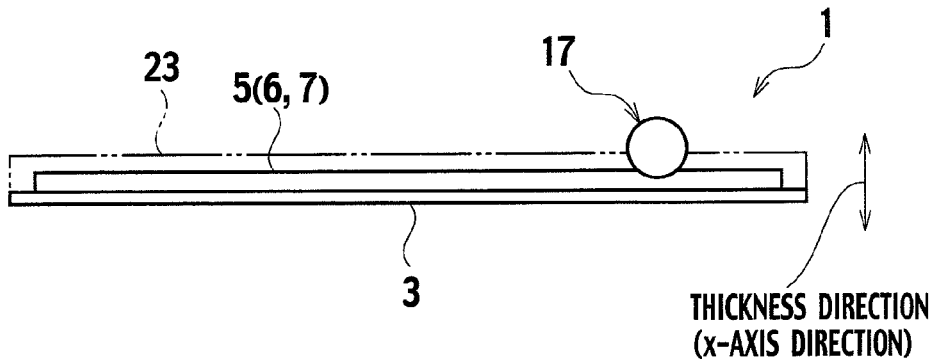

FIG. 1 is a view illustrating a schematic configuration of an antenna 1 according to a first embodiment of the present invention.

The antenna 1 is used in a frequency band of 2.4 GHz to construct a radio LAN or the like by being mounted in an apparatus, for example, a personal computer or the like, and includes a thin (for example, a thickness of about 35 μm) plate-like base 3, which is made of an insulating material (a dielectric constant of about 3.0) such as synthetic resin (for example, polyimide) and which has flexibility.

A conductor 5 having a predetermined shape (for example, copper having a thickness of about 10 μm to 35 μm) is thinly formed integrally on one surface of the base 3 in a thickness direction of the base 3. The conductor 5 is generated by etching or the like, has multiple cut-out portions 10, 13 and 15 to obtain predetermined antenna characteristics (a VSWR characteristic (frequency characteristic), a radiation characteristic (directivity) and the like), and is provided at a predetermined position on the surface of the base 3.

Then, even when the base 3 and the conductor 5 are deformed into predetermined curved surface shapes, the antenna 1 is designed to be capable of mostly maintain the antenna characteristics. Moreover, the conductor 5 is thinly provided, thereby durability against bending of the antenna 1 is improved and skin effect of copper can be obtained.

In more detail explanation, the base 3 is formed rectangularly, for example. The conductor 5 includes a first conductor (ground conductor) 6 having multiple cut-out portions (for example, two cut-out portions) 13 and 15 and a second conductor (radiation conductor) 7 projected from the first conductor 6, and is formed to have an approximately rectangular outer shape. That is, if neither the cut-out portions 13 and 15 of the first conductor 6 nor the cut-out portion 10 formed between the first conductor 6 and the second conductor 7 (cut-out portion formed between the first conductor 6 and the second conductor 7 by projection of the second conductor 7) is present, the conductor 5 is rectangularly formed. Further, the conductor 5 is provided on one surface of the base 3 in the thickness direction of the base 3 so that a longitudinal direction of the conductor 5 and a longitudinal direction of the base 3 match each other.

Figure 2:
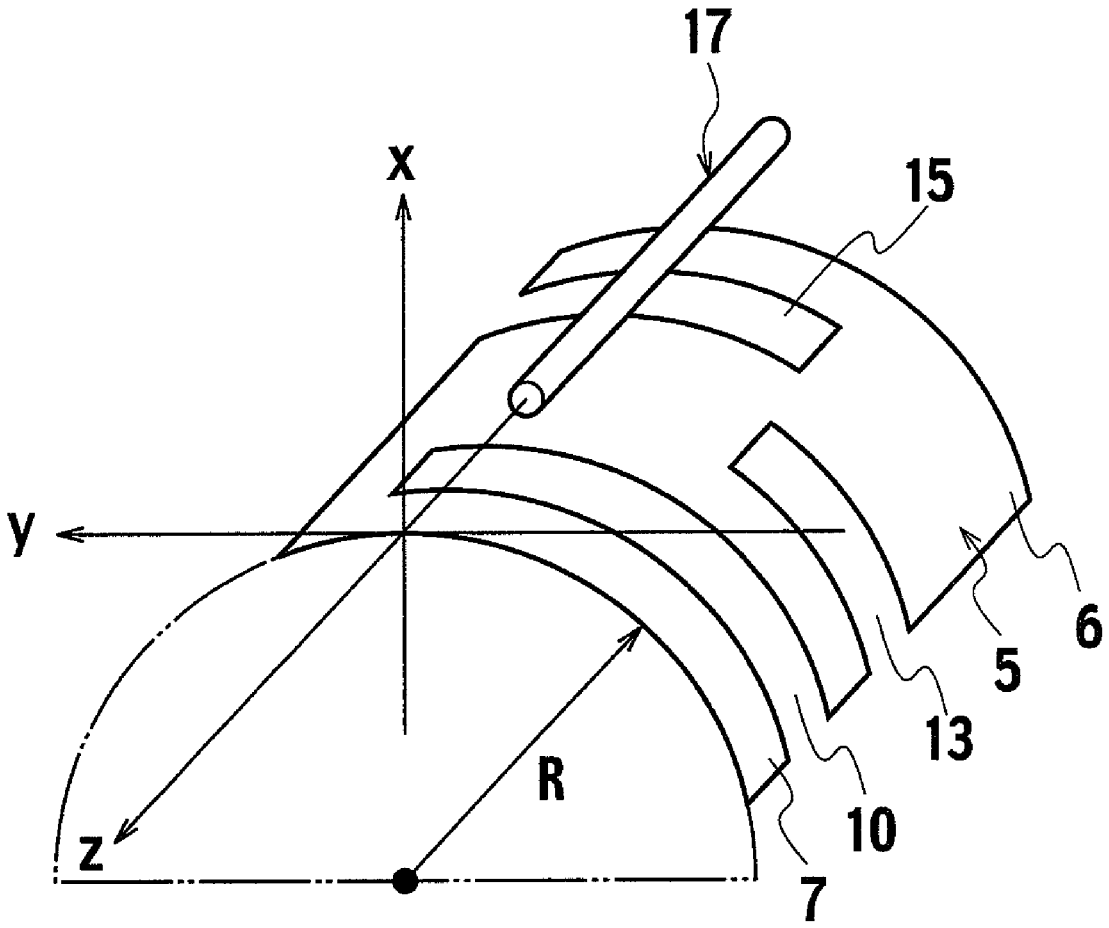
FIG. 2 is a view illustrating a state in which the antenna is deformed.

The predetermined curved-surface shape has a cylindrical side-surface shape where a radius is R as illustrated in FIG. 2, for example, and the conductor 5 is used by being deformed so that one side (long side) and another side (the other long side) opposite to the one side can form a circular-arc shape and the other sides (short sides) are linearly shaped. However, the antenna 1 does not always have to be used in the aforementioned deformed state and there is a case that the base 3 and the conductor 5 are used in a plane shape without being deformed.

The antenna 1 has a coaxial cable 17 as an example of a feeder line, and an inner conductor (center conductor) 21 of the coaxial cable 17 is electrically connected to a predetermined position of the second conductor 7 and an outer conductor (external conductor) 19 of the coaxial cable 17 is electrically connected to a predetermined position of the first conductor 6. It is noted that the coaxial cable 17 having an outer diameter of 0.75 mm to 1.15 mm is used. Moreover, the conductor 5 and the base 3 are used in a deformed state in such a way that a straight line CL, which connects the predetermined position (portion), where the inner conductor 21 of the coaxial cable 17 is connected, to the predetermined position (portion) where the outer conductor 19 of the coaxial cable 17 is connected, extends (extends in a z-axis direction in FIG. 2) in parallel with a center axis of the cylinder (center axis connecting the center of an upper surface of the cylinder to the center of a bottom surface thereof) and that the center axis of the cylinder is parallel to each linear side (each short side) of the base 3.

It is noted that an x-axis illustrated in FIG. 2 is an axis which is perpendicular to the z-axis and extends in a diameter direction of the cylinder. In addition, a z-axis is an axis which is perpendicular to the x-axis and the y-axis.

When the antenna 1 is described in more detail, the first conductor 6 includes the first cut-out portion 13 and the second cut-out portion 15 and is formed to have an approximately rectangular outer shape. In other words, if no cut-out portions 13 and 15 are present, the first conductor 6 is rectangularly shaped.

The second conductor 7 is formed in an "L" shape by a first element 9 and a second element 11.

The first element 9 is formed to have approximately the same length as that of the first conductor 6 and a long narrow rectangular shape, and is provided to be separated away from the first conductor 6 by a predetermined distance (distance approximately the same as the width of the first element 9) at a side of one end portion of the first conductor 6 in a width direction in such a way that a longitudinal direction of the first element 9 is aligned with a longitudinal direction of the first conductor 6 and both end portions of the first element 9 in the longitudinal direction are aligned with both end portions of the first conductor 6 in the longitudinal direction.

The second element 11 is provided so as to electrically connect the first element 9 and the first conductor 6 to each other. Specifically, the second element 11 is formed to have approximately the same width as that of the first element 9, the same length as a distance between the first element 9 and the first conductor 6 and a short rectangular shape, and is provided between the first element 9 and the first conductor 6 and from one end portions of the first element 9 and the first conductor 6 in the longitudinal directions thereof, respectively, to the vicinity of the one end portions.

A first predetermined portion where the outer conductor 19 of the coaxial cable 17 is connected is separated away from the second element 11 of the second conductor 7 by a predetermined distance (distance slightly larger than the width of the second element 11) at the side of the one end portion of the first conductor 6 in the longitudinal direction and extends from one end portion of the first conductor 6 in the width direction to the vicinity of the one end portion.

A second predetermined portion where the inner conductor 21 of the coaxial cable 17 is connected is separated away from the second element 11 of the second conductor 7 by a predetermined distance (approximately the same distance as that of the first predetermined portion; distance slightly larger than the width of the second element 11) at a side of one end portion of the first element 9 of the second conductor 7 in the longitudinal direction and extends in the width direction of the first element 9.

The first cut-out portion 13 is formed to have approximately the same width as that of the first element 9 of the second conductor 7 and a long narrow rectangular shape, and extends from the other end portion of the first conductor 6 in the longitudinal direction to an approximately center portion of the first conductor 6 at the side of the one end portion of the first conductor 6 in the width direction in such a way that a longitudinal direction of the first cut-out portion 13 is aligned with the longitudinal direction of the first conductor 6.

The second cut-out portion 15 is formed to have approximately the same width as that of the first element 9 of the second conductor 7 and a long narrow rectangular shape, and extends from the one end portion of the first conductor 6 in the longitudinal direction to approximately the center portion of the first conductor 6 at a side of the other end portion of the first conductor 6 in the width direction in such a way that the longitudinal direction of the second cut-out portion 15 is aligned with the longitudinal direction of the first conductor 6.

The coaxial cable 17 connected to the conductor 5 extends in a direction of the first predetermined portion (portion where the outer conductor 19 is connected) with the second predetermined portion (portion where the inner conductor 21 is connected) being as a reference point. Further, as described above, the straight line which connects the first predetermined portion and the second predetermined portion to each other extends in the width direction of the first conductor 6 and that of the second conductor 7 (x-axis direction in FIG. 2). Furthermore, seeing from a thickness direction of the base 3 (conductor 5), the conductor 5 (conductors 6 and 7) is present inside the rectangularly formed base 3.

In addition, for example, the conductor 5 and the surface of the base 3, on which the conductor 5 is provided, are covered with a thin insulating film 23.

When the antenna 1 is used by being mounted (e.g., adhered) along the curved surface of the cylinder side surface shape as illustrated in FIG. 2, the respective short sides positioned at both sides of the base 3 in the longitudinal direction of the base 3 are linearly maintained and the respective long sides positioned at both sides of the base 3 in a width direction are deformed into arc shapes. Then, the antenna 1 (base 3 and conductor 5) is deformed into a cylinder side surface shape.

When power is fed to the antenna 1 through the coaxial cable 17, the antenna 1 operates as a monopole antenna and current flows in an extending direction of the coaxial cable 17 and the current is strongly distributed in the vicinity of a feeding point (portions where the inner conductor 21 and the outer conductor 19 of the coaxial cable 17 is connected). Therefore, a main polarized wave is in a direction parallel to the extending direction of the coaxial cable 17, and even when the antenna 1 is deformed as illustrated in FIG. 2, the characteristics of the antenna 1 (frequency characteristic, directivity, and the like) are almost unchanged. In other words, even when the antenna 1 is bent as illustrated in FIG. 2, the characteristics of the antenna 1 are almost unchanged since the current flowing direction remains parallel to the extending direction of the coaxial cable 17 and the current concentrates at the feeding point due to the coaxial cable 17.

A test result of the characteristics of the antenna 1 will be next described.

Figure 3:
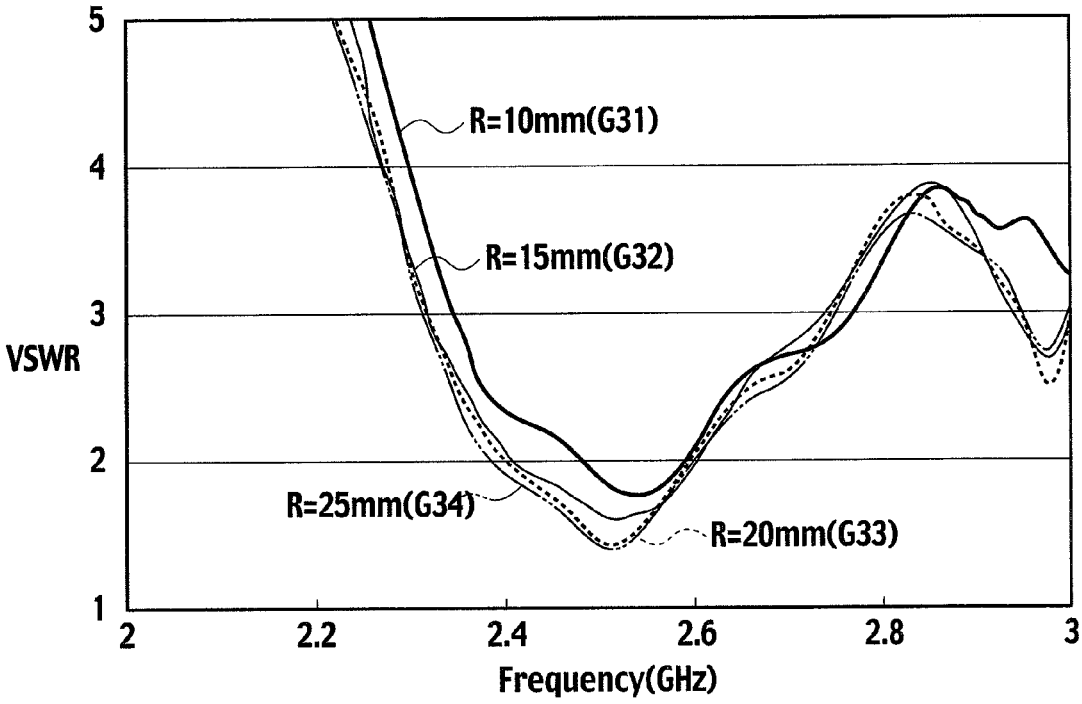
FIG. 3 is a view illustrating a frequency characteristic of the antenna.
Figure 3:
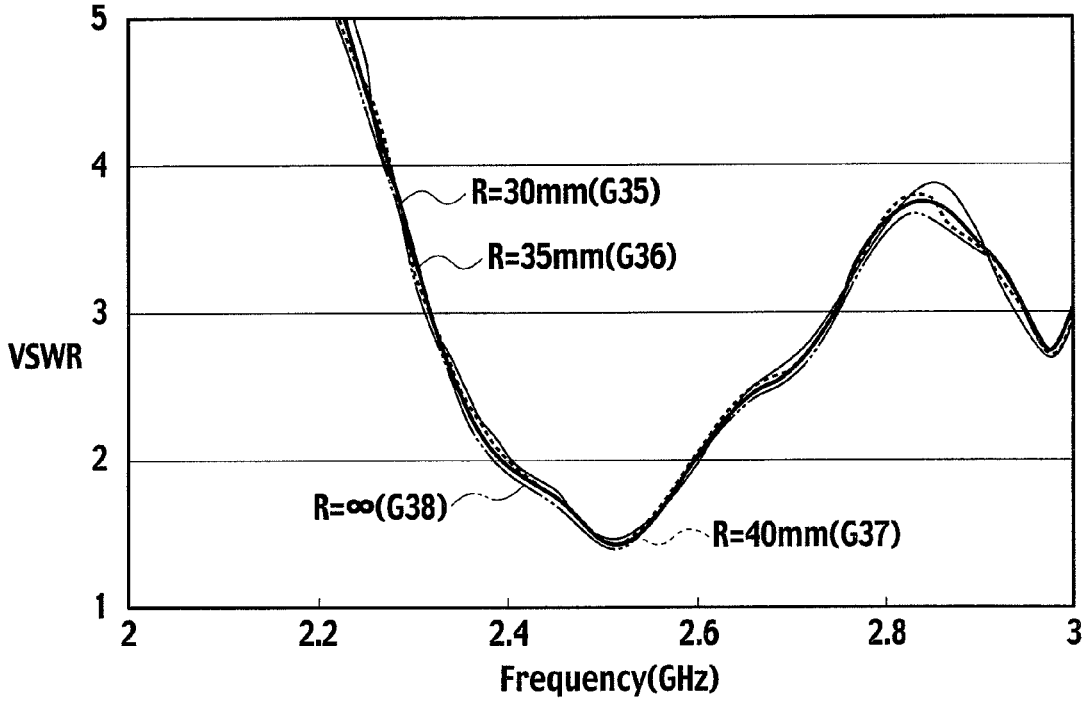

FIG. 3 is a view illustrating a frequency characteristic of the antenna 1.

In FIG. 3, a horizontal axis indicates a frequency and a vertical axis indicates a VSWR (Voltage Standing Wave Ratio) value. A range where an absolute value of VSWR is "not more than 2" corresponds to a resonance frequency band.

A graph G31 illustrated in FIG. 3 is a graph indicating a frequency characteristic at the time when the antenna 1 is deformed into a cylinder side surface shape as illustrated in FIG. 2 and a radius R is 10 mm. When the radius R is 10 mm, the resonance frequency band having a VSWR absolute value of "not more than 2" corresponds to a range from 2.48 GHz to 2.59 GHz.

Likewise, graphs G32 to G37 illustrated in FIG. 3 are graphs each indicating a frequency characteristic at the time when the antenna 1 is deformed into a cylinder side surface shape as illustrated in FIG. 2 and each radius R is changed. Moreover, a graph G38 illustrated in FIG. 3 is a graph indicating a frequency characteristic at the time when the antenna 1 is plane-shaped.

In the graph G32 (R=15 mm), the resonance frequency band ranges from 2.41 GHz to 2.59 GHz, but in the graphs G33 to G38, the resonance frequency band ranges from 2.40 GHz to 2.59 GHz. Therefore, when a bending radius is 20 mm or more, it is possible to obtain the same frequency characteristic as that obtained when the antenna 1 is used in a plane shape.

Figure 4:
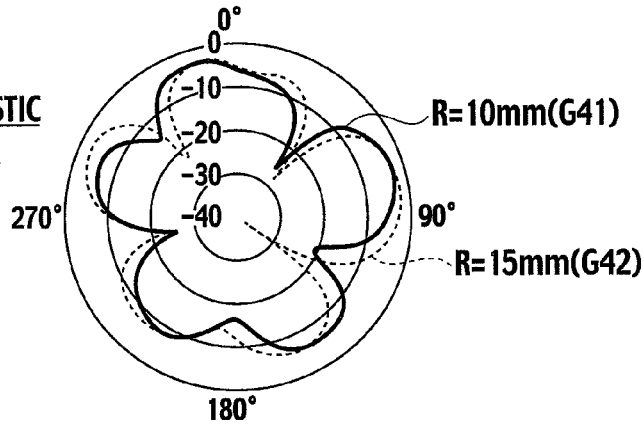
FIG. 4 is a view illustrating directivity of a main polarized wave of the antenna at the time when the antenna is deformed as illustrated in FIG. 2.
Figure 4:
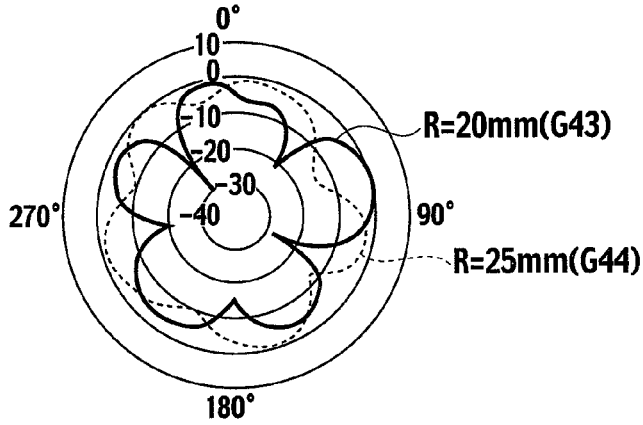
Figure 4:
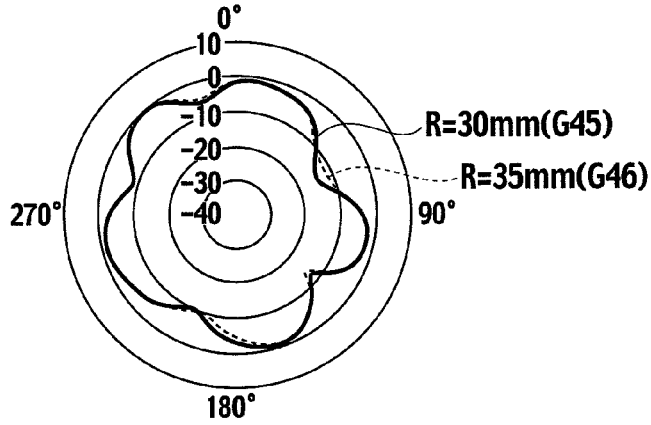
Figure 4:
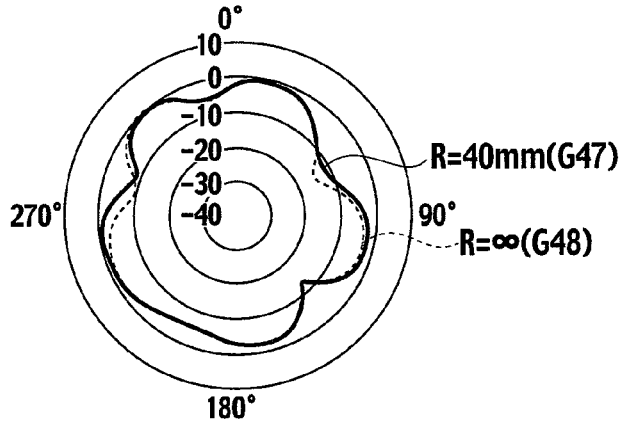
Figure 5:
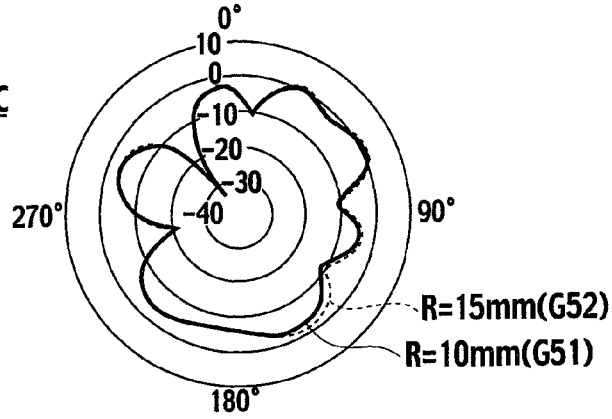
FIG. 5 is a view illustrating directivity of the main polarized wave of the antenna at the time when the antenna is deformed as illustrated in FIG. 2.
Figure 5:
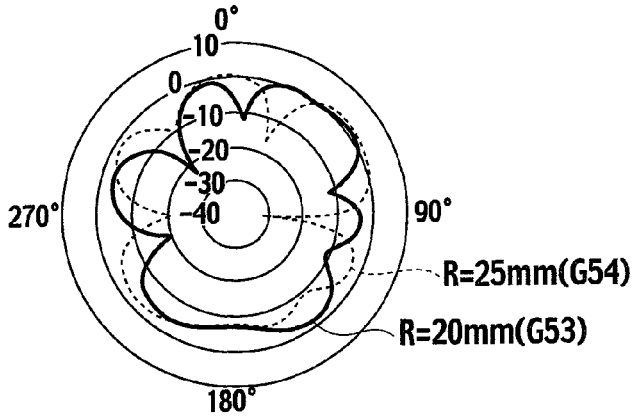
Figure 5:
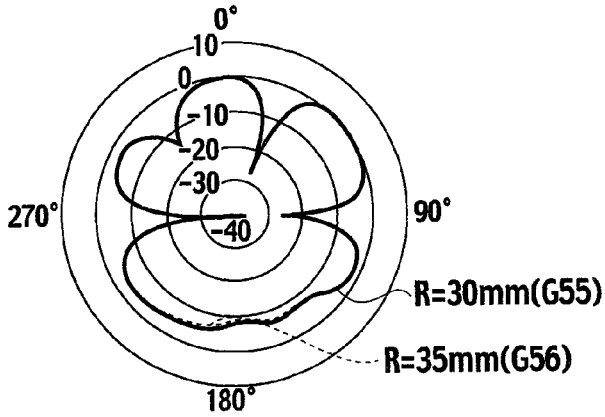
Figure 5:
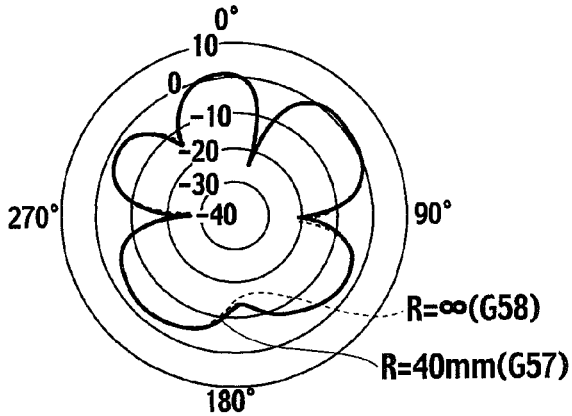
Figure 6:
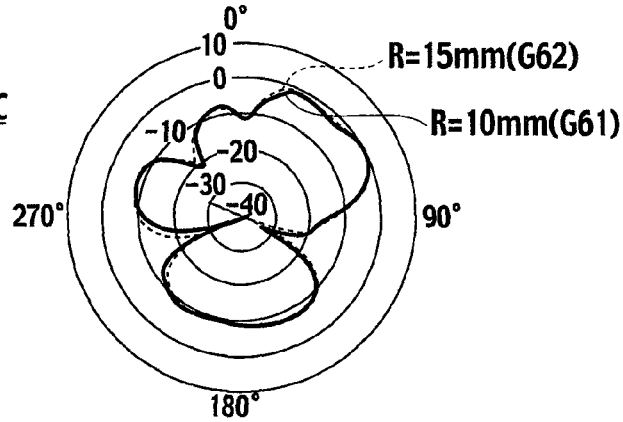
FIG. 6 is a view illustrating directivity of the main polarized wave of the antenna at the time when the antenna is deformed as illustrated in FIG. 2.
Figure 6:
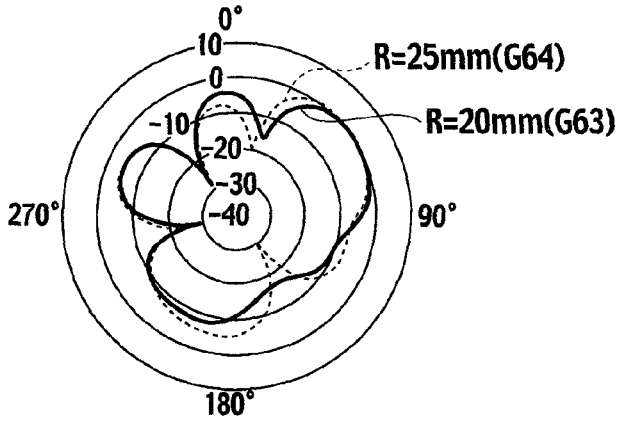
Figure 6:
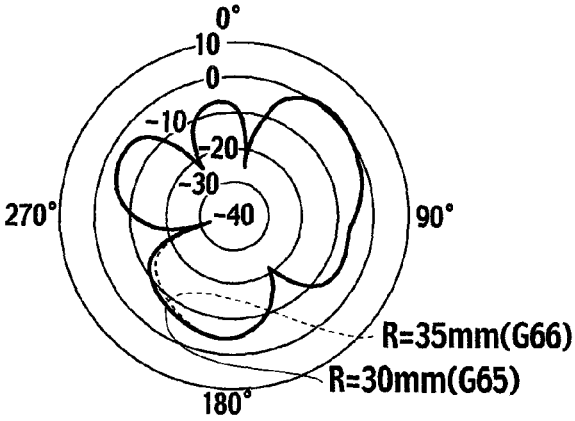
Figure 6:
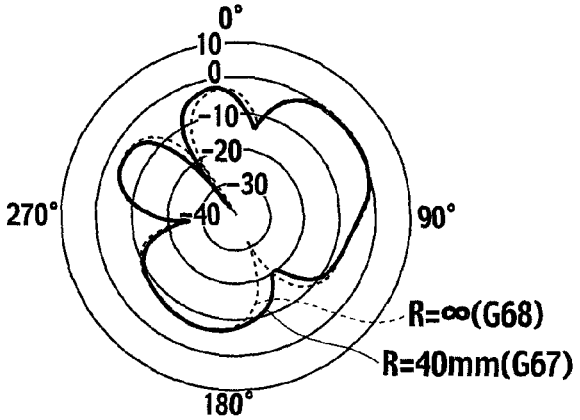

FIG. 4 to FIG. 6 are views each illustrating directivity of the main polarized wave of the antenna 1 at the time when the antenna 1 is deformed as illustrated in FIG. 2, FIG. 4 illustrates a characteristic of an xy plane, FIG. 5 illustrates a characteristic of a yz plane, and FIG. 6 illustrates a characteristic of a zx plane.

As is understood from graphs G41 to G48, G51 to G58 and G61 to G68 in FIG. 4 to FIG. 6, if the bending radius is 20 mm or more, it is possible to obtain the same directivity as that obtained when the antenna 1 is used in a plane shape as in the case of the frequency characteristic.

Figure 7:
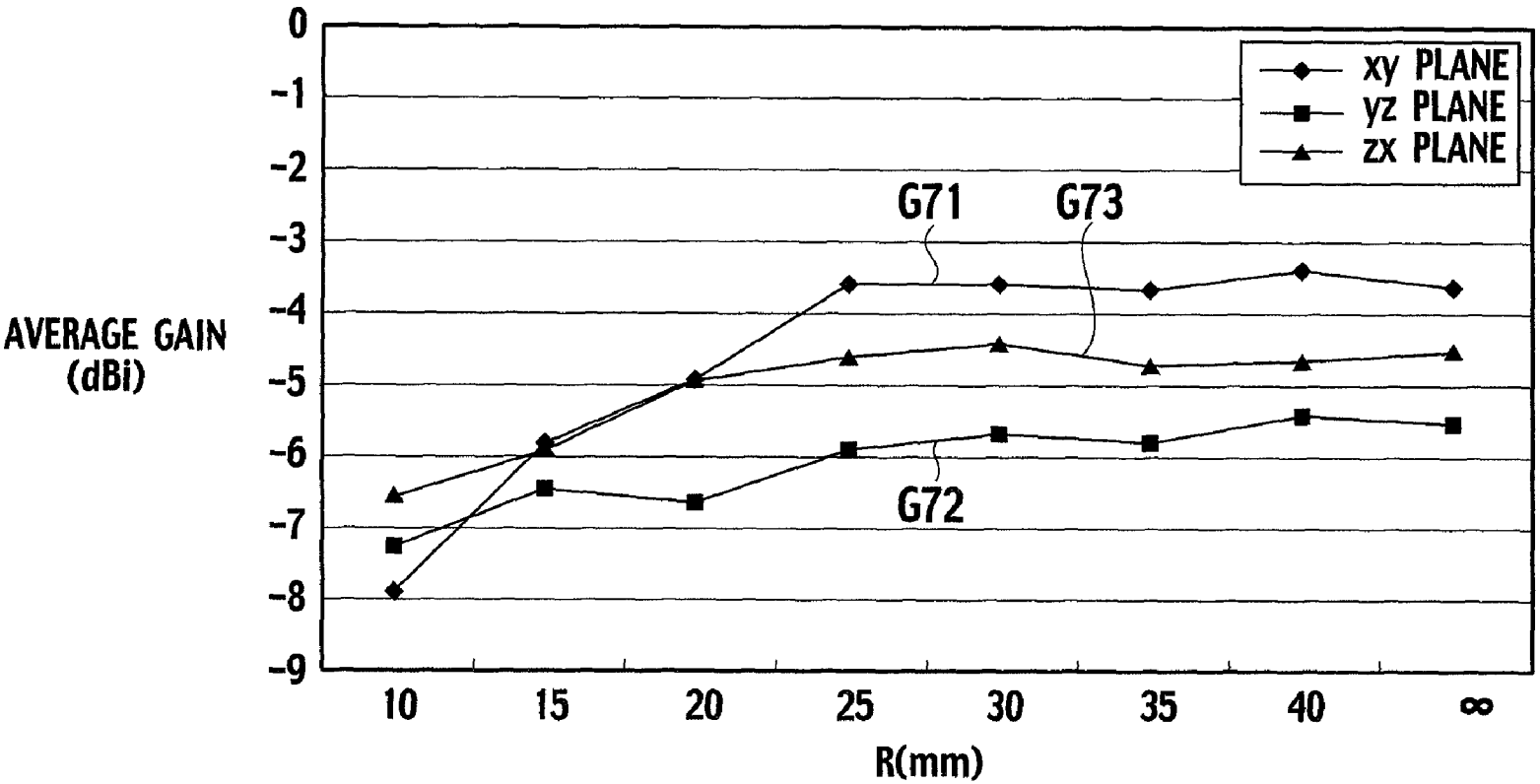
FIG. 7 is a view illustrating a relationship between a bending radius R of the antenna and an average gain.

FIG. 7 is a view illustrating a relationship between a bending radius R of the antenna 1 and an average gain at the time when the antenna 1 is deformed as illustrated in FIG. 2.

As is understood from graphs G71 to G73 in FIG. 7, if the bending radius is 20 mm or more, it is possible to obtain the same average gain as that obtained when the antenna 1 is used in a plane shape as in the cases of the frequency characteristic and directivity.

Therefore, if the antenna 1 is mounted as illustrated in FIG. 2 and the bending radius is set to 20 mm or more, it is possible to obtain the same antenna characteristic as that obtained when the antenna 1 is used in a plane shape. In other words, the antenna 1 can be used if the antenna 1 is mounted as illustrated in FIG. 2 and the bending radius is 20 mm or more.

In the antenna 1, the base 3 and the conductor 5 have flexibility, and therefore the antenna 1 can be mounted in an apparatus such as a personal computer by being deformed into a curved surface shape or bent as described later, and can be mounted in a setting space smaller than the conventional case.

Moreover, multiple cut-out portions 13 and 15 are formed in the first conductor 6, thereby making it possible to miniaturize the first conductor 6, and obtain good antenna characteristics (frequency characteristic, directivity, and average gain) as illustrated in FIG. 3 to FIG. 7 even when the antenna is deformed into a curved surface shape or bent.

Second Embodiment

Figure 8:
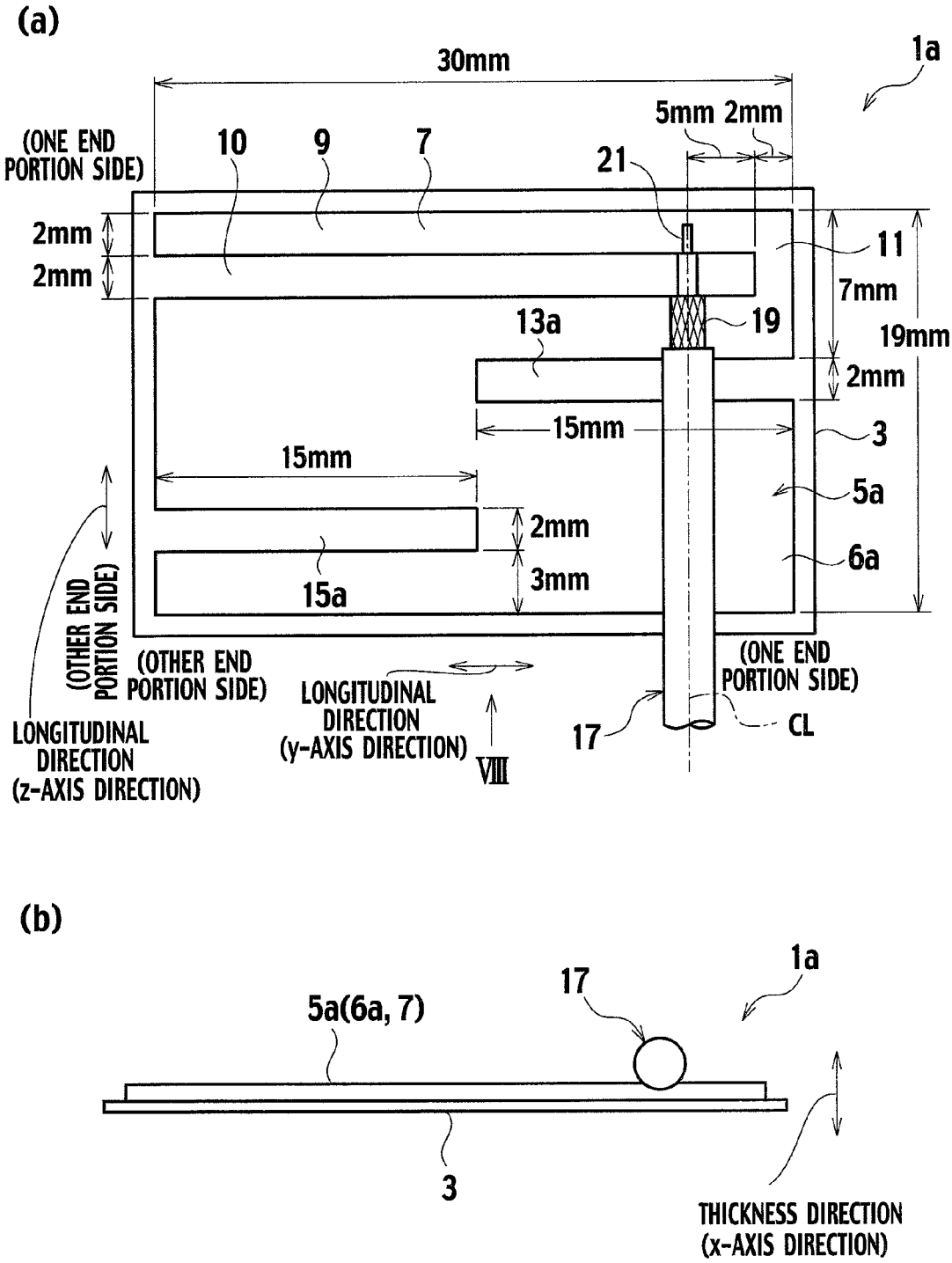
FIG. 8 is a view illustrating a schematic configuration of an antenna according to a second embodiment of the present invention.

FIG. 8 is a view illustrating a schematic configuration of an antenna 1*a* according to a second embodiment of the present invention.

The antenna 1*a* according to the second embodiment is configured in the same way as that of the antenna 1 according to the first embodiment and exhibits approximately the same effects except in that the positions of cut-out portions 13*a* and 15*a* formed in a first conductor 6*a* (conductor 5*a*) are reversed in a longitudinal direction of the first conductor 6*a*.

Specifically, the first cut-out portion 13*a* of the antenna 1*a* according to the second embodiment is formed to have approximately the same width as that of the first element 9 of the second conductor 7 and a long narrow rectangular shape, and extends from one end portion of the first conductor 6*a* in the longitudinal direction to an approximately center portion of the first conductor 6*a* at a side of the one end portion of the first conductor 6*a* in the width direction in such a way that a longitudinal direction of the first cut-out portion 13*a* is aligned with the longitudinal direction of the first conductor 6*a*.

Moreover, the second cut-out portion 15*a* of the antenna 1*a* according to the second embodiment is formed to have approximately the same width as that of the first element 9 of the second conductor 7 and a long narrow rectangular shape, and extends from the other end portion of the first conductor 6*a* in the longitudinal direction to an approximately center portion of the first conductor 6*a* at a side of the other end portion of the first conductor 6*a* in the width direction in such a way that a longitudinal direction of the second cut-out portion 15*a* is aligned with the longitudinal direction of the first conductor 6*a*.

A test result of the characteristics of the antenna 1*a* will be next described.

Figure 9:
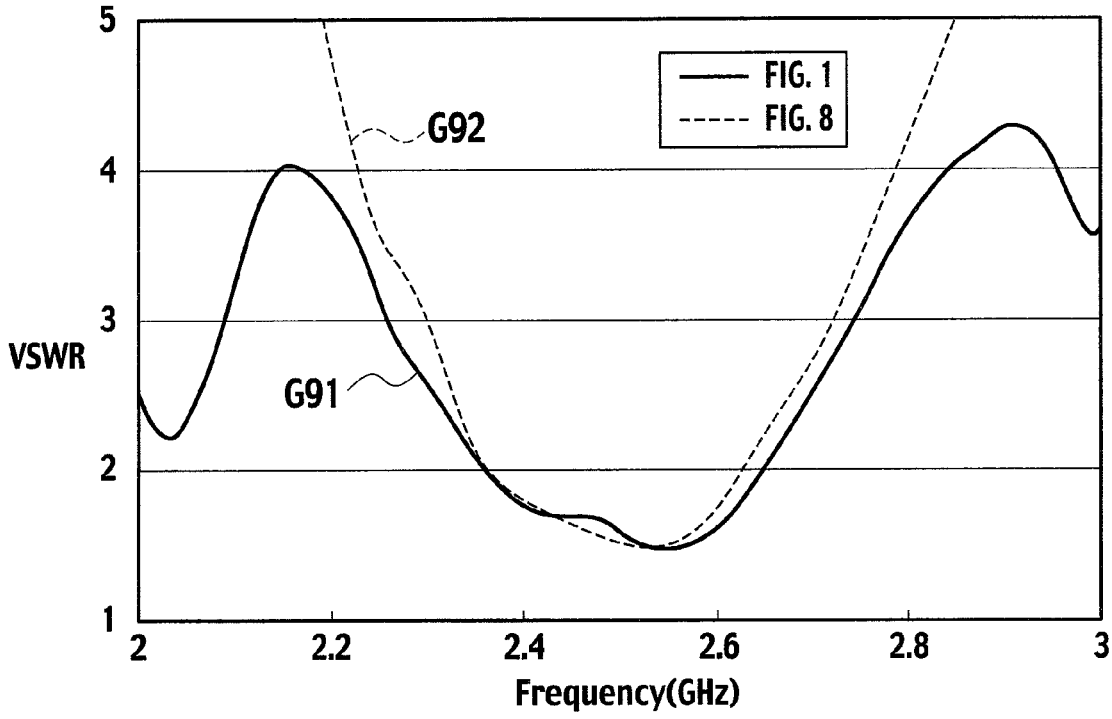
FIG. 9 is a view illustrating the frequency characteristics of the antenna according to the first embodiment and the antenna according to the second embodiment, respectively.

FIG. 9 is a view illustrating the frequency characteristics of the antenna 1 and the antenna 1*a*, and a graph G91 indicates a frequency characteristic of the antenna 1 and a graph G92 indicates a frequency characteristic of the antenna 1*a*. It is noted that the antennas 1 and 1*a* are plane-shaped. As is understood from FIG. 9, the antenna 1*a* can obtain approximately the same frequency characteristic as that of the antenna 1.

Figure 10:
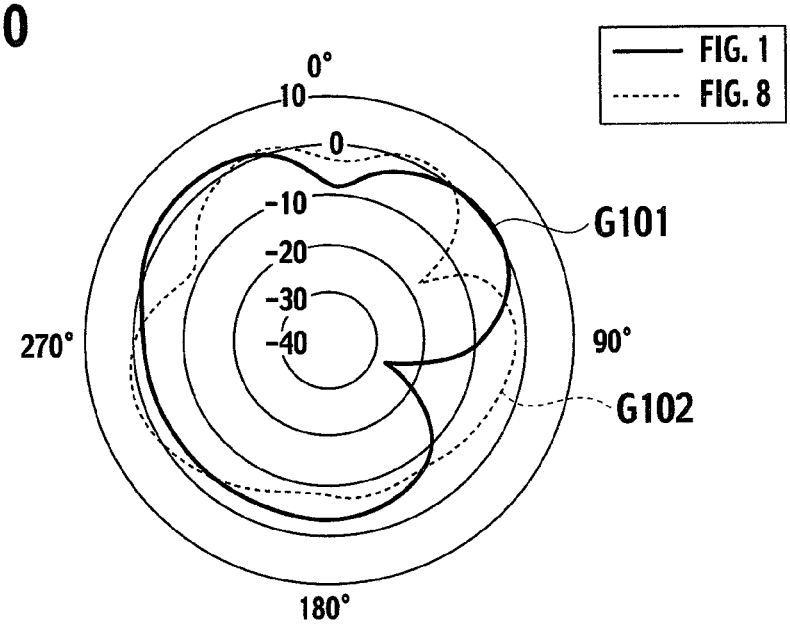
FIG. 10 is a view illustrating directivity of the main polarized waves of the antenna according to the first embodiment and the antenna according to the second embodiment, respectively, in the arrangement as illustrated in FIG. 2.
Figure 11:
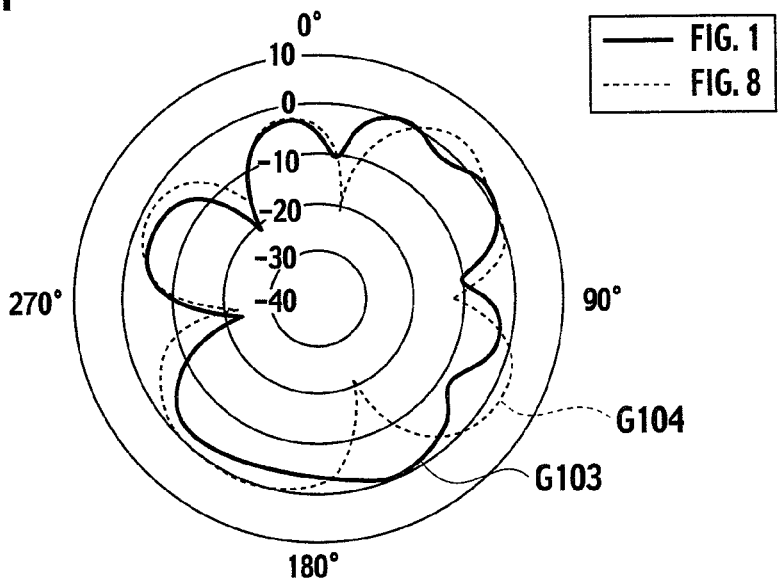
FIG. 11 is a view illustrating directivity of the main polarized waves of the antenna according to the first embodiment and the antenna according to the second embodiment, respectively, in the arrangement as illustrated in FIG. 2.
Figure 12:
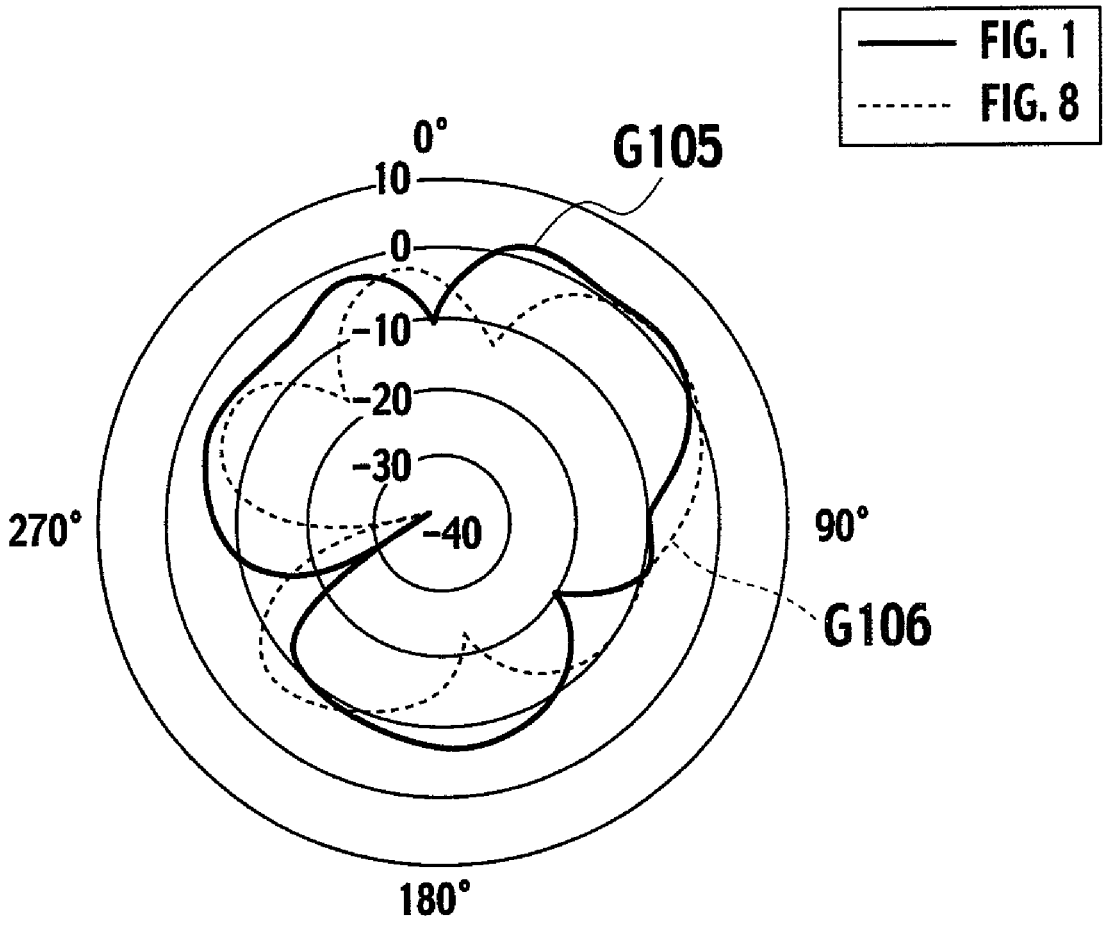
FIG. 12 is a view illustrating directivity of the main polarized waves of the antenna according to the first embodiment and the antenna according to the second embodiment, respectively, in the of arrangement as illustrated in FIG. 2.

FIG. 10 to FIG. 12 are views each illustrating directivity of the main polarized wave of each of the antennas 1 and 1*a* at the time when the antenna 1 and the antenna 1*a* are placed as illustrated in FIG. 2, FIG. 10 illustrates a characteristic of an xy plane, FIG. 11 illustrates a characteristic of a yz plane, and FIG. 12 illustrates a characteristic of a zx plane. It is noted that the antennas 1 and 1*a* are plane-shaped.

Graphs G101, G103 and G105 in FIG. 10 to FIG. 12 indicate directivity of the antenna 1 according to the first embodiment and graphs G102, G104 and G106 in FIG. 10 to FIG. 12 indicate directivity of the antenna 1*a* according to the second embodiment. As is understood from FIGS. 10 to 12, in the frequency band of 2.4 GHz, the antenna 1*a* can obtain approximately the same directivity as that of the antenna 1.

Figure 13:
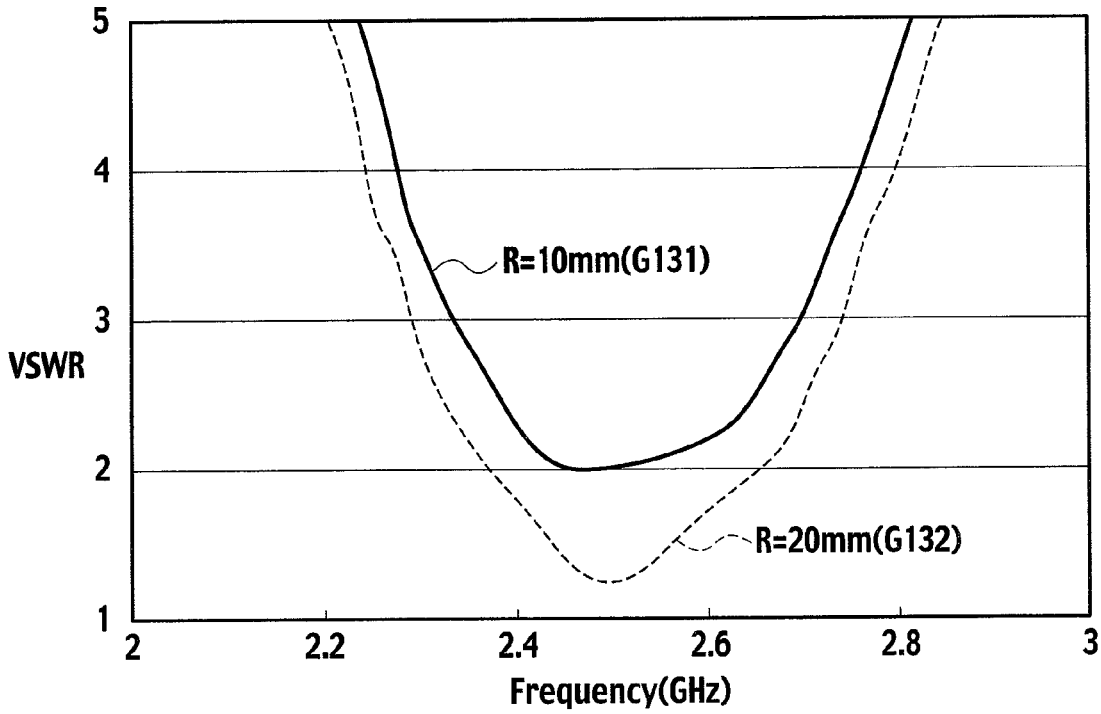
FIG. 13 is a view illustrating a relationship between a bending radius R of the antenna and an average gain.
Figure 13:
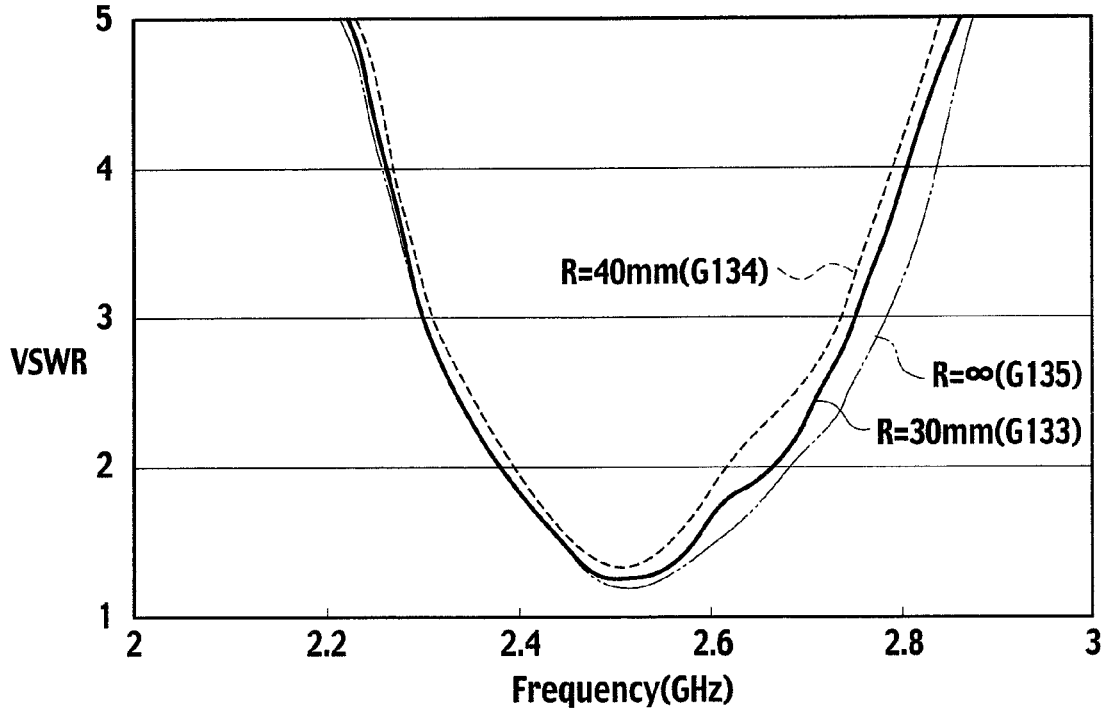

FIG. 13 is a view illustrating a relationship between a bending radius R and an average gain in the antenna 1*a*.

As is understood from graphs G131 to G135 in FIG. 13, if the bending radius is 20 mm or more when the antenna 1*a* is mounted as illustrated in FIG. 2, it is possible to obtain the same average gain as that obtained when the antenna 1*a* is used in a plane shape as in the cases of the frequency characteristic and directivity.

FIG. 14 is a view illustrating average gains of the antennas 1 and 1*a* at the time when the antennas 1 and 1*a* are mounted in a plane shape. As is understood from FIG. 14, the antenna 1*a* can obtain approximately the same average gain as that of the antenna 1.

Third Embodiment

Figure 15:
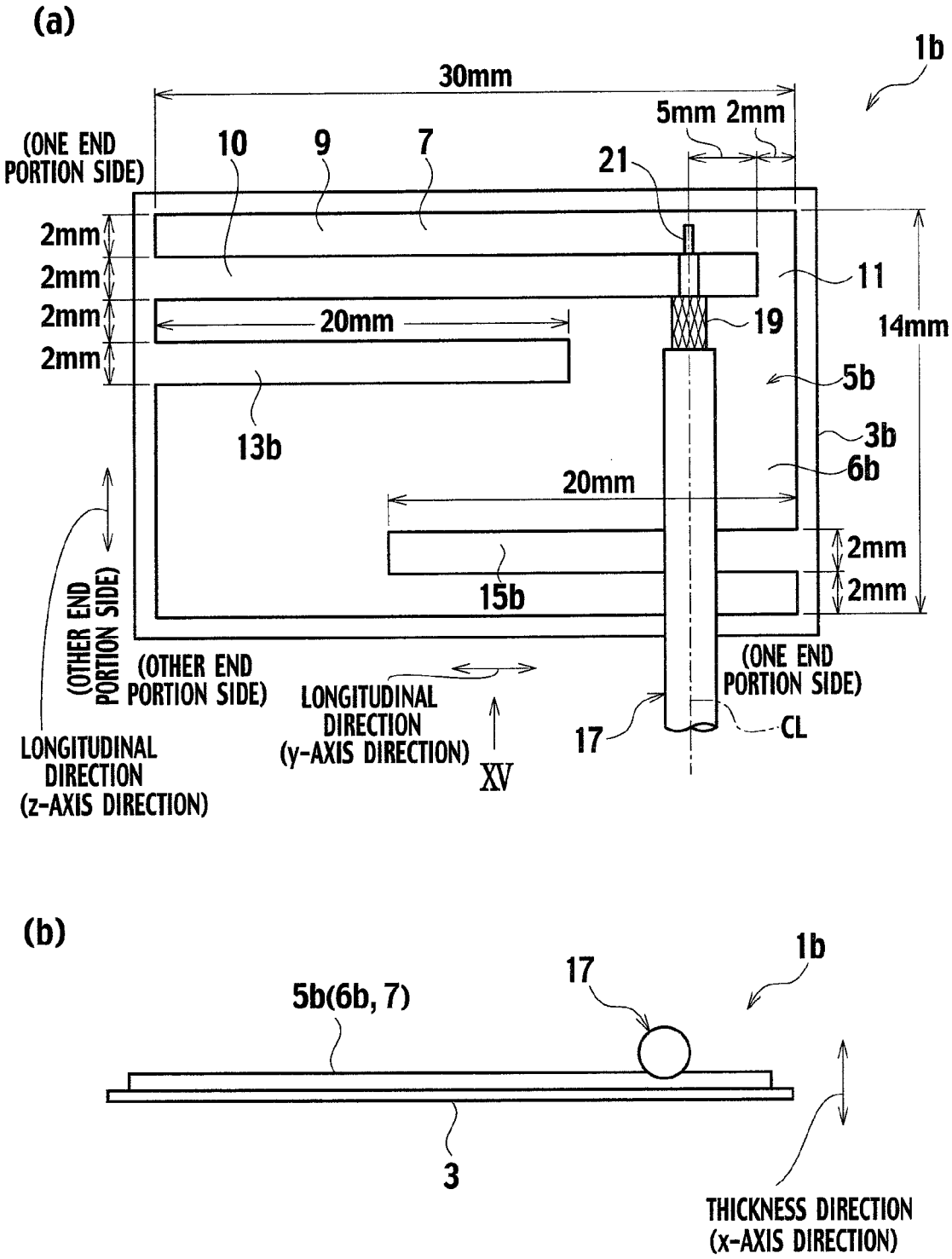
FIG. 15 is a view illustrating a schematic configuration of an antenna according to a third embodiment of the present invention.

FIG. 15 is a view illustrating a schematic configuration of an antenna 1*b* according to a third embodiment of the present invention.

The antenna 1*b* according to the third embodiment of the present invention is different from the antenna 1 according to the first embodiment in the points that a first conductor 6*b* is formed to have a slightly smaller width than the antenna 1 according to the first embodiment and cut-out portions 13*b* and 15*b* are formed to be slightly longer, but regarding the other points, the antenna 1*b* is configured in approximately the same way as that of the antenna 1 of the first embodiment.

Specifically, the antenna 1*b* according to the third embodiment includes a thin plate-like base 3*b* is made of insulating material, and conductor 5*b* of a predetermined shape, which has multiple cut-out portions 13*b* and 15*b* and is thinly formed at a predetermined position on a surface of the base 3 so as to obtain a predetermined antenna characteristics. The antenna 1*b* is designed to be mostly capable of maintaining antenna characteristics even when the base 3*b* and the conductor 5*b* are bent along a predetermined straight line L1 (see FIG. 16)

More specifically, similar to the antenna 1, the base 3*b* is formed to have a thin rectangular plate shape, a first conductor 6*b* is also formed to have approximately a rectangular shape, the second conductor 7 is formed in an "L" shape, and the coaxial cable 17 is also provided as in the case of the antenna 1.

The first cut-out portion 13*b* of the first conductor 6*b* is formed to have approximately the same width as that of the first element 9 of the second conductor 7 and a long narrow rectangular shape, and extends to a portion at a side of one end portion of the first conductor 6*b* in a longitudinal direction from the other end portion of the first conductor 6*b* in the longitudinal direction at a side of the one end portion of the first conductor 6*b* in a width direction in such a way that a longitudinal direction of the cut-out portion 13*b* is aligned with the longitudinal direction of the first conductor 6*b*.

The second cut-out portion 15*b* of the first conductor 6*b* is formed to have approximately the same width as that of the first element 9 of the second conductor 7 and extends from the one end portion of the first conductor 6*b* in the longitudinal direction to a portion at a side of the other end portion of the first conductor 6*b* in the longitudinal direction at a side of the other end portion of the first conductor 6*b* in the width direction in such a way that a longitudinal direction of the second cut-out portion 15*b* is aligned with the longitudinal direction of the first conductor 6*b*.

A test result of the characteristics of the antenna 1*b* will be next described.

Figure 16:
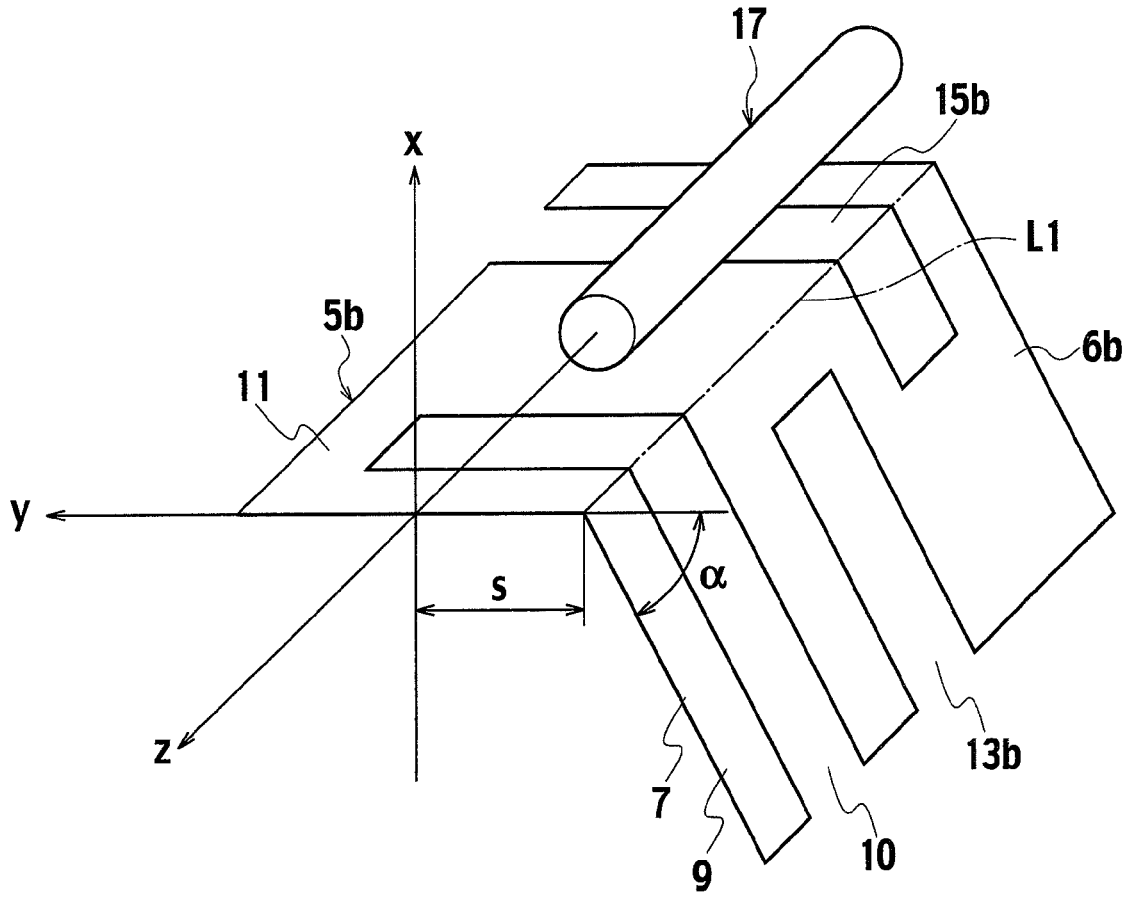
FIG. 16 is a view illustrating a state in which the antenna is deformed.

The antenna 1*b* may be used in a bent state as illustrated in FIG. 16. It is noted that, in FIG. 16, an extending direction of the coaxial cable 17 is a z-axis direction as in the case of FIG. 2, and a thickness direction of the antenna 1*b* (thickness direction of the base 3*b* and that of the conductor 5) is an x-axis direction. Moreover, a bent line (straight line) L1 in FIG. 16 extends in a z-axis direction. "S" illustrated in FIG. 16 indicates a distance from the center of the coaxial cable 17 to the bent line L1 and "α" indicates a bending angle of the antenna 1*b*.

Figure 17:
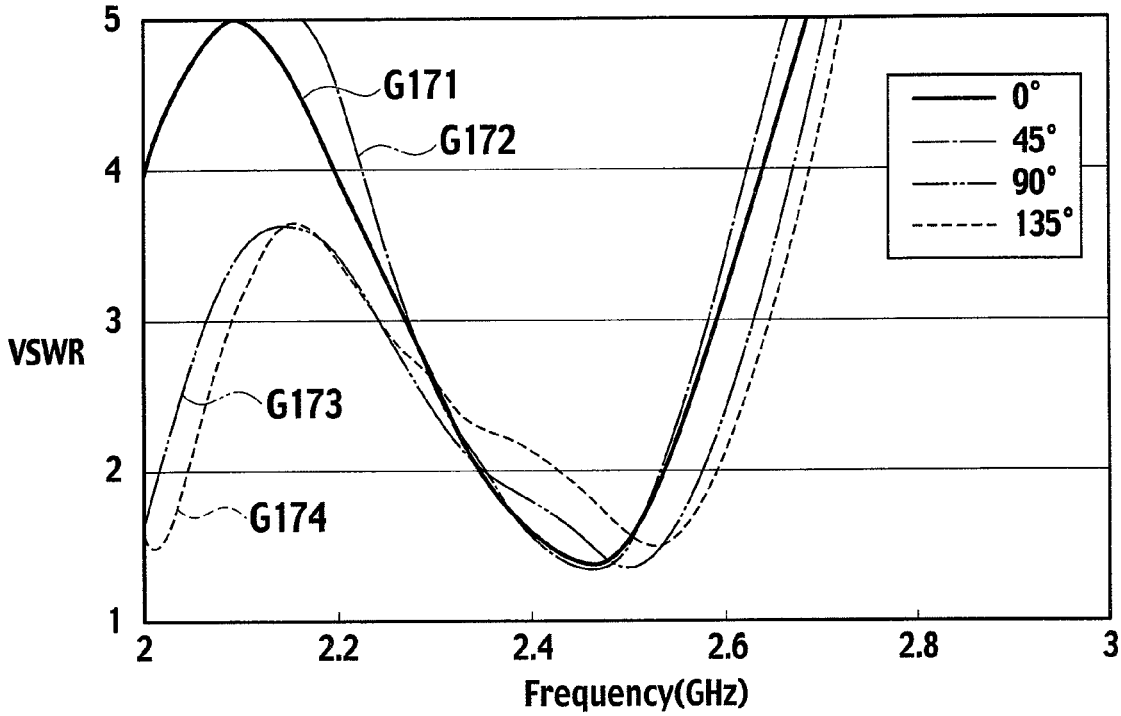
FIG. 17 is a view illustrating a frequency characteristic of the antenna at the time when a distance S in FIG. 16 is set to "0 mm."

FIG. 17 is a view illustrating a frequency characteristic of the antenna 1*b* at the time when the distance S in FIG. 16 is set to "0 mm."

In FIG. 17, a graph G171 indicates a frequency characteristic at the time when the angle α is "0°," a graph G172 indicates a frequency characteristic at the time when the angle α is "45°," a graph G173 indicates a frequency characteristic at the time when the angle α is "90°," and a graph G174 indicates a frequency characteristic at the time when the angle α is "135°."

Figure 18:
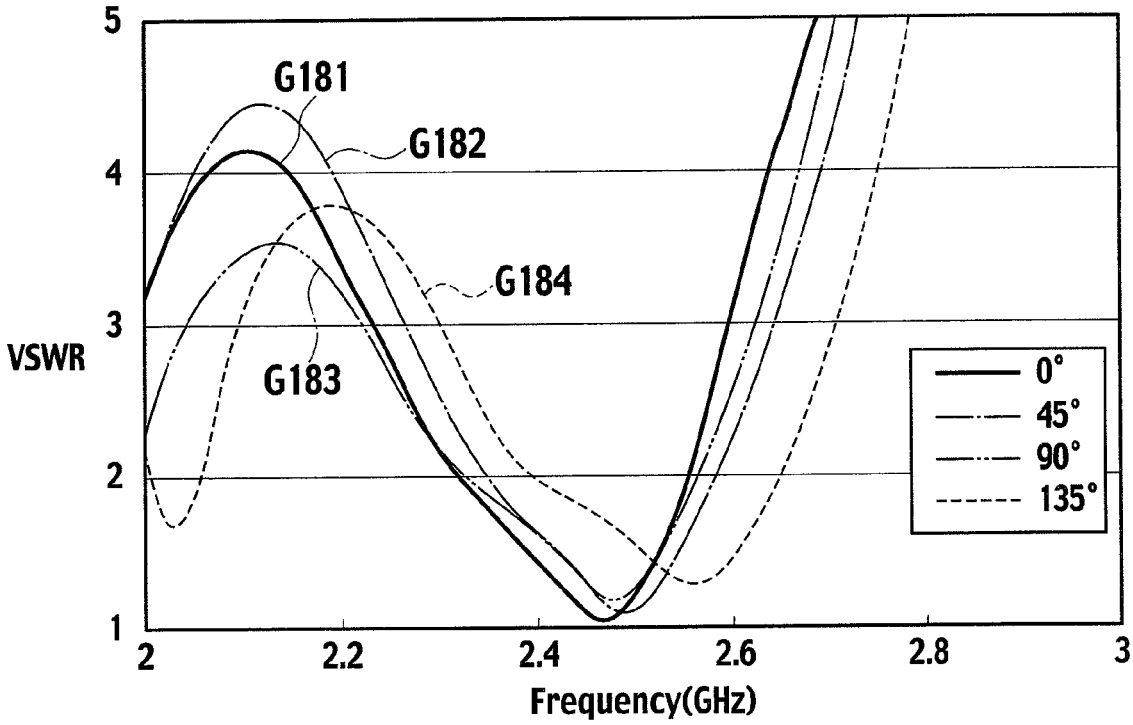
FIG. 18 is a view illustrating a frequency characteristic of the antenna at the time when the distance S in FIG. 16 is set to "16 mm."

FIG. 18 is a view illustrating a frequency characteristic of the antenna 1*b* at the time at the time when the distance S in FIG. 16 is set to "16 mm."

In FIG. 18, a graph G181 indicates a frequency characteristic at the time when the angle α is "0°," a graph G182 indicates a frequency characteristic at the time when the angle α is "45°," a graph G183 indicates a frequency characteristic at the time when the angle α is "90°," and a graph G184 indicates a frequency characteristic at the time when the angle α y is "135°."

As is understood from FIG. 17 and FIG. 18, in the antenna 1*b*, if the bending angle α c is an acute angle which is 90° or less, it is possible to obtain a good frequency characteristic (resonance frequency band of 2.40 GHz).

Figure 19:
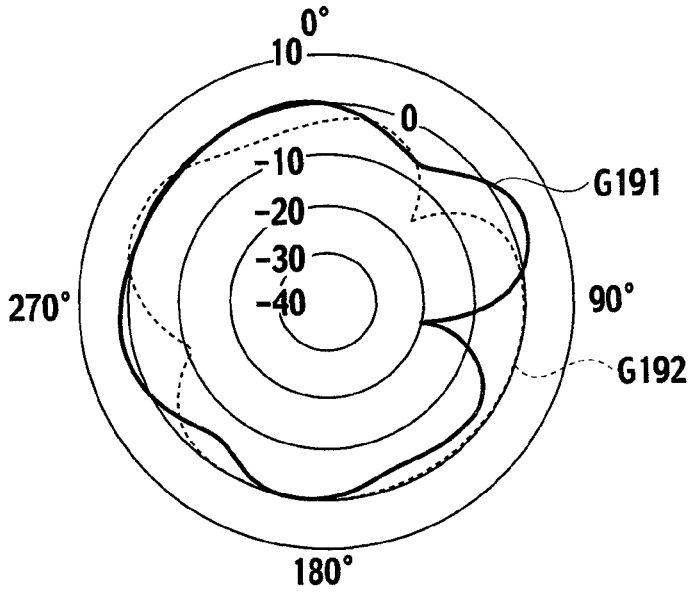
FIG. 19 is a view illustrating directivity (directivity of an xy plane) of the antenna at the time when the distance S in FIG. 16 is set to "0 mm."
Figure 19:
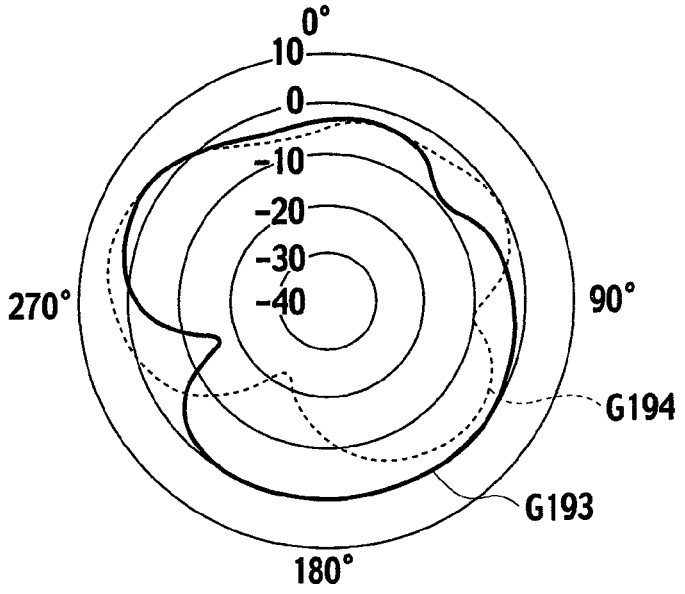

FIG. 19 is a view illustrating directivity (directivity of an xy plane) of the antenna 1*b* at the time when the distance S in FIG. 16 is set to "0 mm."

In FIG. 19, a graph G191 indicates directivity at the time when the angle α is "0°," a graph G192 indicates a frequency characteristic at the time when the angle α is "45°," a graph G193 indicates a frequency characteristic at the time when the angle α"90°," and a graph G194 indicates a frequency characteristic at the time when the angle α is "135°."

Figure 20:
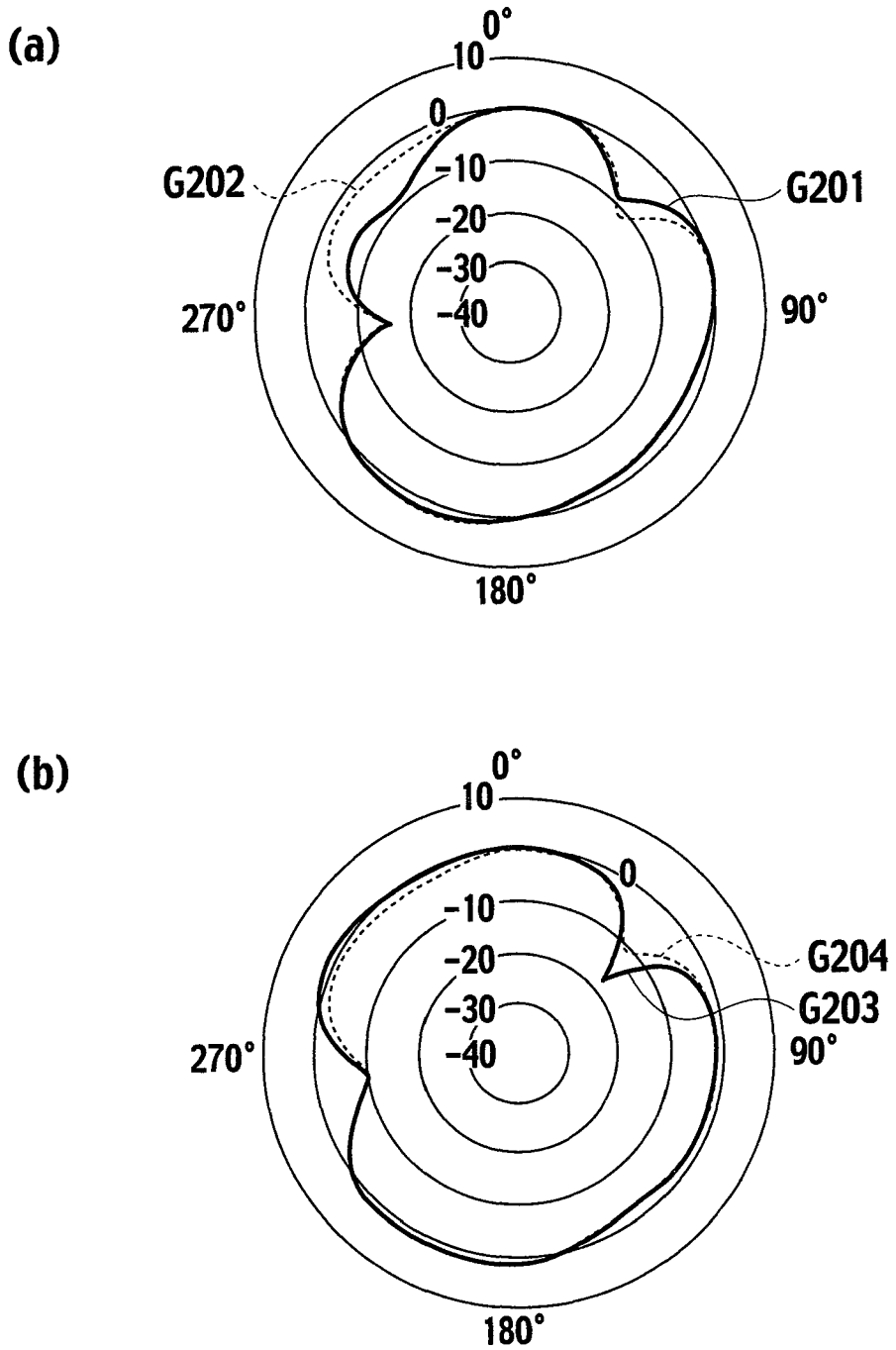
FIG. 20 is a view illustrating directivity (directivity of the xy plane) of the antenna at the time when the distance S in FIG. 16 is set to "16 mm."

FIG. 20 is a view illustrating directivity (directivity of an xy plane) of the antenna 1*b* at the time when the distance S in FIG. 16 is set to "16 mm."

In FIG. 20, a graph G201 indicates directivity at the time when the angle α is "0°," a graph G202 indicates a frequency characteristic at the time when the angle α is "45°," a graph G203 indicates a frequency characteristic at the time when the angle α is "90°," and a graph G204 indicates a frequency characteristic at the time when the angle α is "135°."

As is understood from FIG. 19 and FIG. 20, in the antenna 1*b*, if the bending angle α is an acute angle which is 90° or less, it is possible to obtain an approximately favorable directivity. Further, as is understood from FIG. 17 to FIG. 20, in a case where the distance S is larger, it is possible to maintain the favorable directivity even if the angle α is increased.

FIG. 21 illustrates an average gain in each of the distance S and the angle α.

Meanwhile, the antenna 1*b* may be used not only in the bent state but also by being deformed into a cylinder side surface shape as illustrated in FIG. 2.

FIG. 22 is a view illustrating an average gain at the time when the antenna 1*b* is deformed into a cylinder side surface shape and a gain based on a bending radius R (infinite; including the case of the plane shape).

Figure 23:
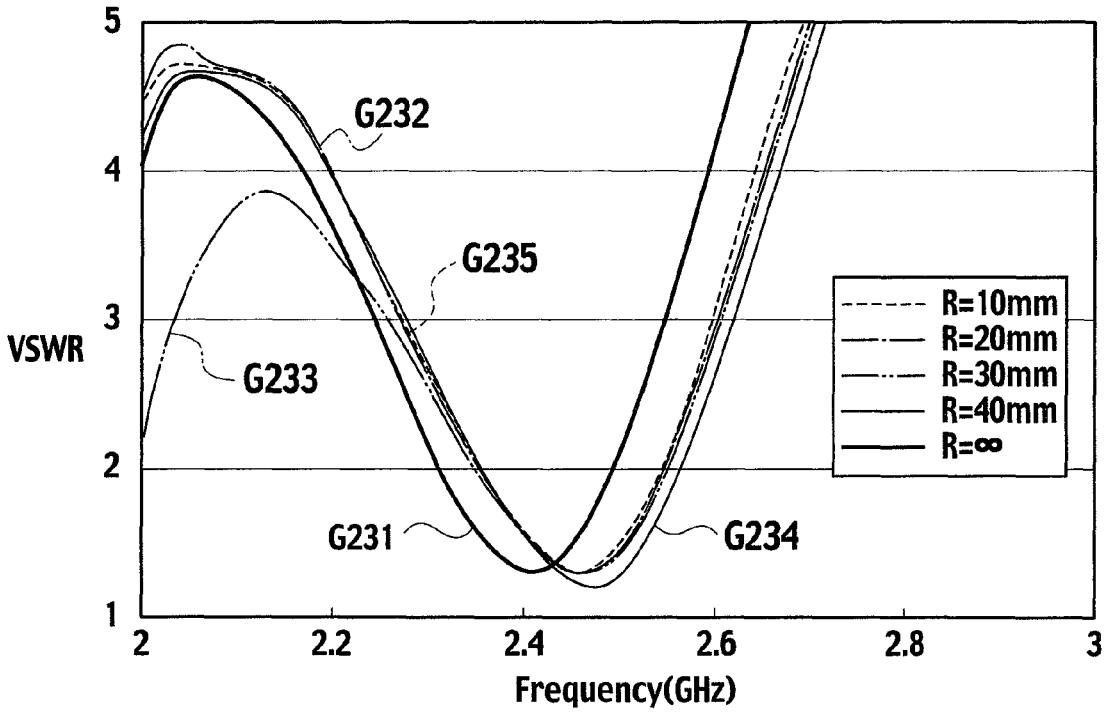
FIG. 23 is a view illustrating a frequency characteristic at the time when the antenna is deformed into a cylinder side surface shape.

FIG. 23 is a view illustrating a frequency characteristic at the time when the antenna 1*b* is deformed into a cylinder side surface shape.

In FIG. 23, a graph G231 indicates a frequency characteristic at the time when the bending radius R of the antenna 1*b* is set to 10 mm, a graph G232 indicates a frequency characteristic at the time when the bending radius R of the antenna 1*b* is set to 20 mm, a graph G233 indicates a frequency characteristic at the time when the bending radius R of the antenna 1*b* is set to 30 mm, a graph G234 indicates a frequency characteristic at the time when the bending radius R of the antenna 1*b* is set to 40 mm, and a graph G235 indicates a frequency characteristic at the time when the antenna 1*b* is plane-shaped.

As is understood from FIG. 23, when the bending radius R of the antenna 1*b* is 10 mm or more, it is found that the frequency characteristic of the antenna 1*b* is maintained in a good state.

Figure 24:
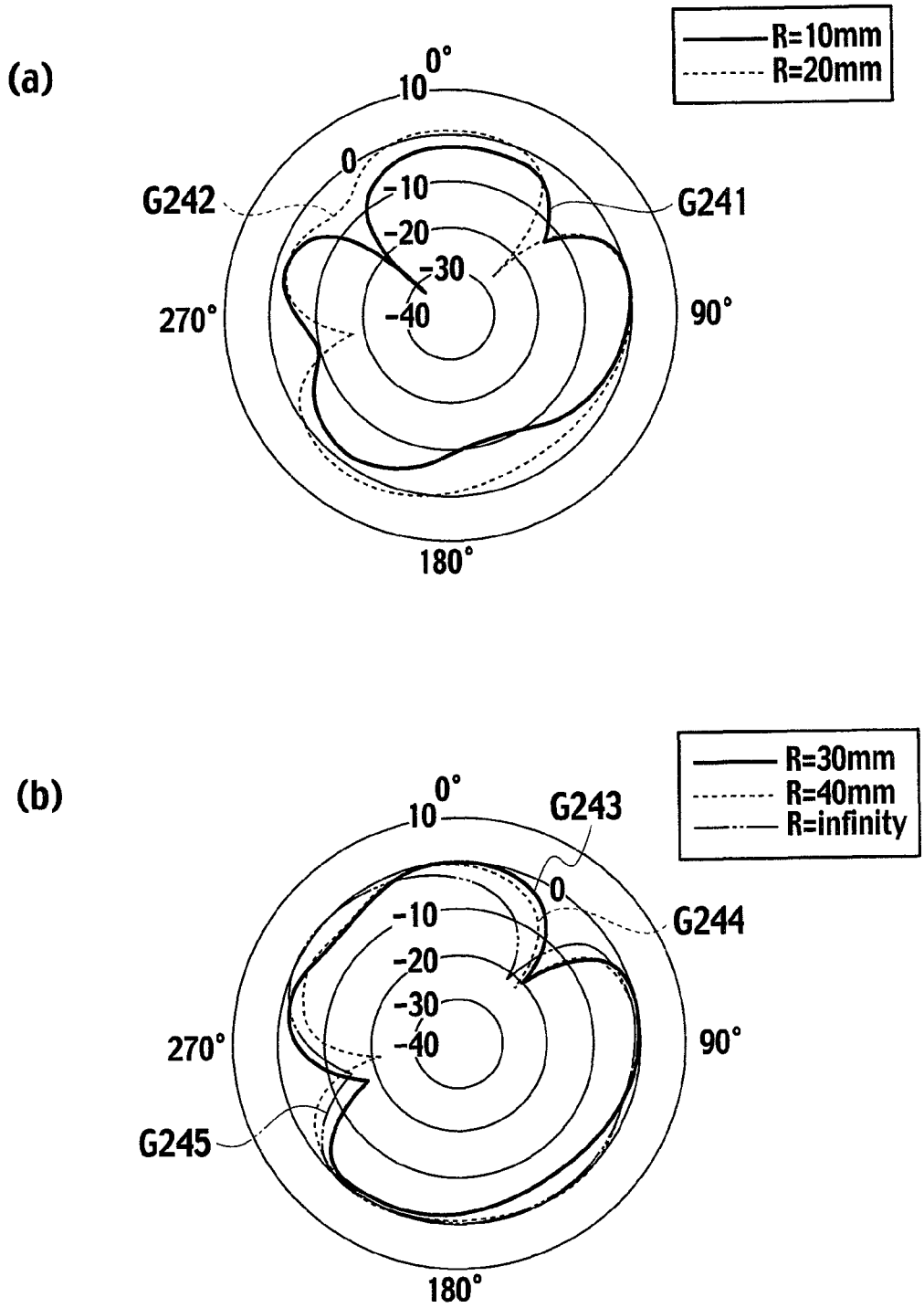
FIG. 24 is a view illustrating directivity (directivity of an xy plane) of the antenna at the time when the antenna is deformed into a cylinder side surface shape.

FIG. 24 is a view illustrating directivity (directivity of an xy plane) of the antenna 1*b* at the time when the antenna 1*b* is deformed into a cylinder side surface shape.

In FIG. 24, a graph G241 indicates directivity at the time when the bending radius R of the antenna 1*b* is set to 10 mm, a graph G242 indicates directivity at the time when the bending radius R of the antenna Ibis is set to 20 mm, a graph G243 indicates directivity at the time when the bending radius R of the antenna 1*b* is set to 30 mm, a graph G244 indicates directivity at the time when the bending radius R of the antenna 1*b* is set to 40 mm, and a graph G245 indicates directivity at the time when the antenna 1*b* is plane-shaped.

As is understood from FIG. 24, if the bending radius R is 20 mm or more, it is found that the directivity of the antenna 1*b* is maintained in a good state.

It is noted that, the cut-out portions 13*b* and 15*b* of the first conductor 6*b* of the antenna 1*b* are formed to be longer than the cut-out portions 13 and 15 of the antenna 1, and thereby, the width size can be reduced to be smaller than that of the antenna 1 of the first embodiment.

Fourth Embodiment

Figure 25:
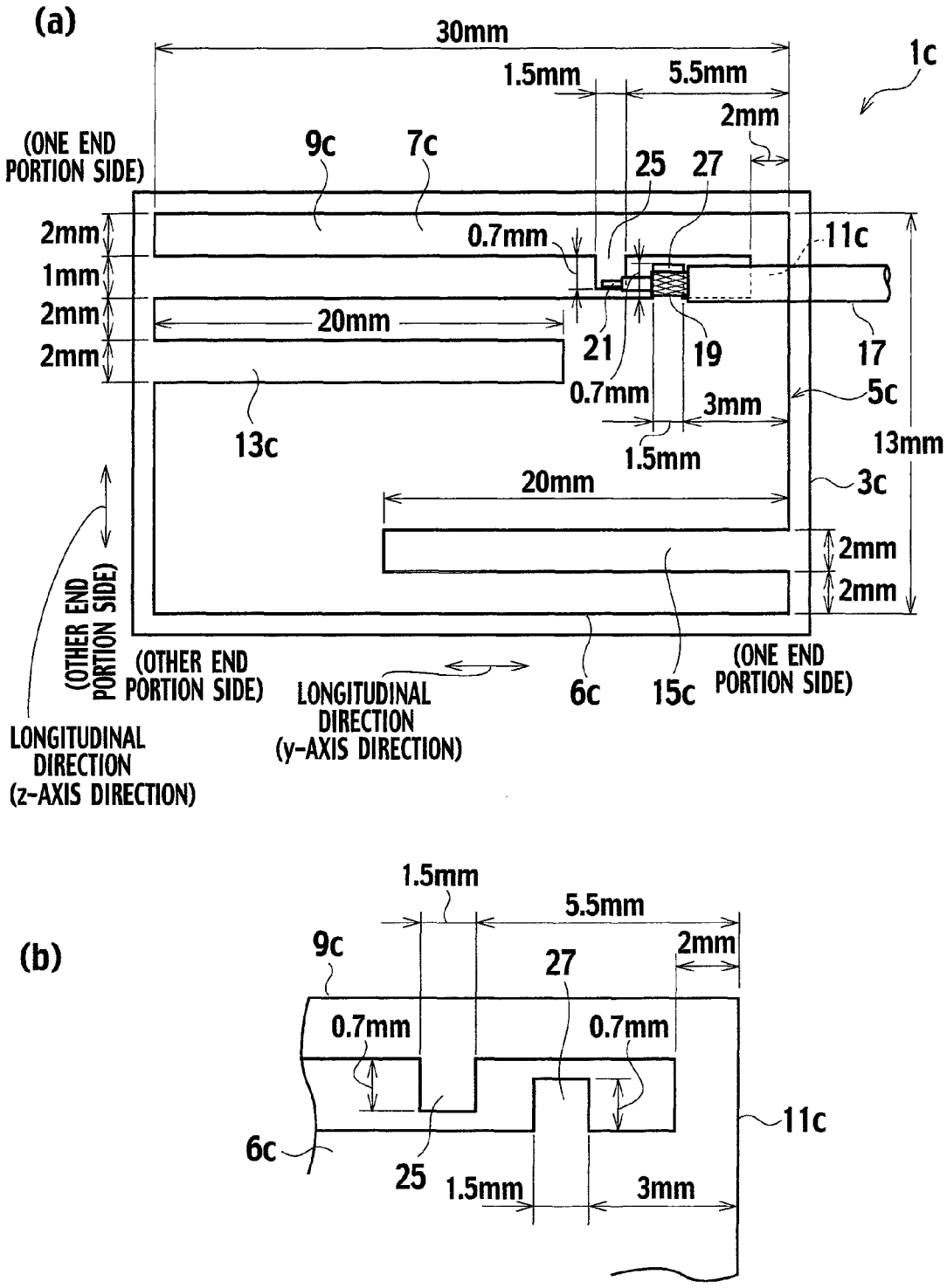
FIG. 25 is a view illustrating a schematic configuration of an antenna according to a fourth embodiment of the present invention.

FIG. 25 is a view illustrating a schematic configuration of an antenna 1*c* according to a fourth embodiment of the present invention. Part (b) of FIG. 25 is a view illustrating an enlarged peripheral portion where connection sections 25 and 27 are provided, and display of the coaxial cable is omitted to facilitate understanding of this embodiment.

The antenna 1*c* according to the fourth embodiment of the present invention is different from the antenna 1*b* according to the third embodiment in the points that connection sections 25 and 27 projecting from a first conductor 6*c* and a second conductor 7*c* are provided and the inner conductor 21 and the outer conductor 19 of the coaxial cable 17 are electrically connected to the connection sections 25 and 27, respectively, but regarding the other points, the antenna 1*c* is configured in approximately the same way as that of the antenna 1*b* of the third embodiment.

That is to say, the antenna 1*c* according to the fourth embodiment of the present invention is configured to include a base 3*c*, the first conductor 6*c*, the second conductor 7*c*, the connection sections 25 and 27, and the coaxial cable 17.

The first conductor 6*c* is approximately rectangularly shaped and formed on one surface of the base 3*c*. It is noted that a first cut-out portion 13*c* and a second cut-out portion 15*c* are formed on the first conductor 6*c*.

The second conductor 7*c* includes a first element 9*c* and a second element 11*c* and is formed in an "L" shape. The first element 9*c* is formed to have approximately the same length as that of the first conductor 6*c* and a long narrow rectangular shape. Then, the first element 9*c* is provided to be separated away from the first conductor 6*c* by a predetermined distance at a side of the one end portion of the first conductor 6*c* in a width direction in such a way that a longitudinal direction of the first element 9*c* is aligned with a longitudinal direction of the first conductor 6*c*.

The second element 11*c* is formed to have a short rectangular shape, and is provided on one surface of the base 3*c* between the first element 9*c* and the first conductor 6*c* and from one end portion of the first element 9*c* in the longitudinal direction to the vicinity of the one end portion so as to connect the first element 9*c* and the first conductor 6*c* to each other. It is noted that a distance (for example, 1 mm) between the first element 9*c* and the first conductor 6*c* is smaller than a width (for example, 2 mm) of the first element 9*c*.

Moreover, although the lengths of the first conductor 6*c* and the first element 9*c* are 30 mm, they may be changed as appropriate within the range of 26 mm to 30 mm if a value of VSWR is "2" or less in the range from 2.2 GHz to 2.6 GHz.

The first connection section 25 is thinly provided on one surface of the base 3*c* similar to the conductors 6*c* and 7*c*, and is formed rectangularly to have a width (for example, 0.7 mm) slightly smaller than the distance (for example, 1 mm) between the first conductor 6*c* and the first element 9*c* and a length (for example, 1.5 mm) slightly larger than the width. Further, the first connection section 25 is located between the first conductor 6*c* and the first element 9*c* and on the first element 9*c* side in the width direction of the first conductor 6*c*, and is located on the second element 11*c* side in the longitudinal direction of the first conductor 6*c*.

Furthermore, in the first connection section 25, one long side is separated away from the first conductor 6*c* by a predetermined slight distance (for example, 0.3 mm; 1 mm to 0.7 mm) and the other long side is electrically connected to the first element 9*c*. Note that, as is already understood, the first connection section 25 is formed of conductors, and is thinly provided on the surface where the conductors 6*c* and 7*c* of the base 3*c* are provided integrally with a conductor 5*c* (conductors 6*c*, 7*c*).

The second connection section 27 is also thinly provided on one surface of the base 3*c*, similar to the conductors 6*c* and 7*c*, and is rectangularly formed similar to the first conductor 6*c*. Further, the second connection section 27 is located between the first conductor 6*c* and the first element 9*c* and on the first conductor 6*c* side in the width direction of the first conductor 6*c*.

Furthermore, in the second connection section 27, one long side is separated away from the first element 9*c* by a predetermined slight distance and the other long side is electrically connected to the first conductor 6*c*. Note that, as is already understood, the second connection section 27 is also formed of conductors, and is thinly provided on the surface where the conductor 5*c* of the base 3*c* is provided integrally with the conductor 5*c*.

In the coaxial cable 17, the inner conductor 21 is electrically connected to the first connection section 25 and the outer conductor 19 is electrically connected to the second connection section 27. Note that the coaxial cable 17 extends to the one end portion side of the first conductor 6*c* in the longitudinal direction (side where the second element 11*c* is provided; right side in FIG. 25).

Note that, in the antenna 1*c*, a mounting form of the coaxial cable 17 may be reversely set. Specifically, the inner conductor may be connected to the second connection section 27 where the outer conductor 19 is connected, and the outer conductor 19 may be connected to the first connection section 25 where the inner conductor 21 is connected so that the coaxial cable 17 can extend to the left side in FIG. 25.

In the antenna 1*c*, the coaxial cable 17 extends to the one end portion side of the first conductor 6*c* in the longitudinal direction (longitudinal direction of the antenna 1*c*), and therefore can be easily mounted in a location where it is difficult to handle coaxial cable 17 wiring in the antennas 1, 1*a*, 1*b* according to the first to third embodiments.

A test result of the characteristics of the antenna 1*c* will be next described.

Figure 26:
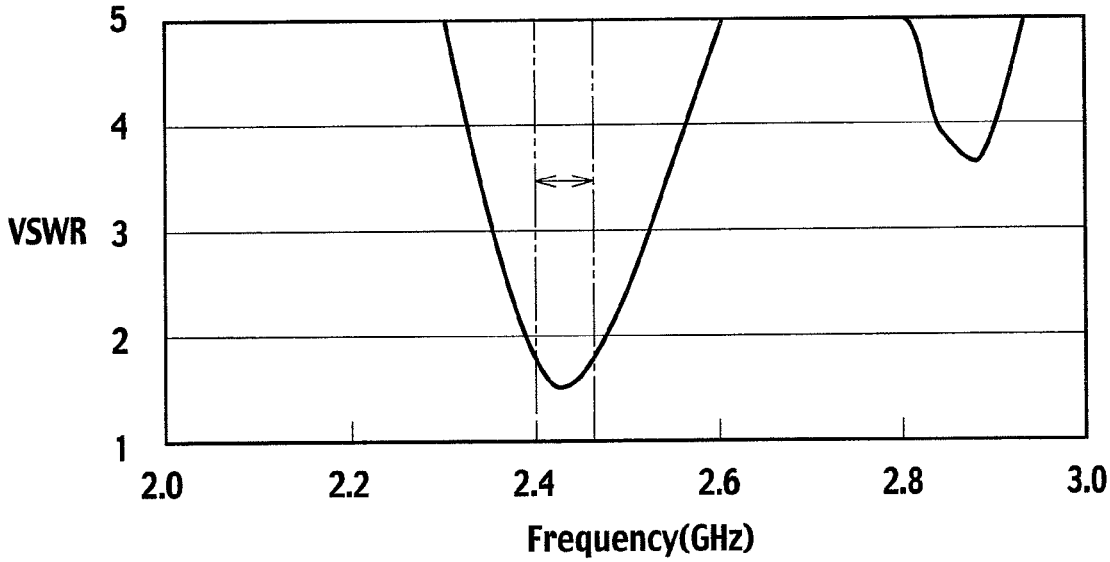
FIG. 26 is a view illustrating a frequency characteristic of the antenna.

FIG. 26 is a view illustrating a frequency characteristic of the antenna 1*c*.

As is understood from FIG. 26, in the antenna 1*c*, the range from 2.4 GHz to 2.4835 GHz (range illustrated by an arrow in FIG. 26) corresponds to a resonance frequency band.

Figure 27:
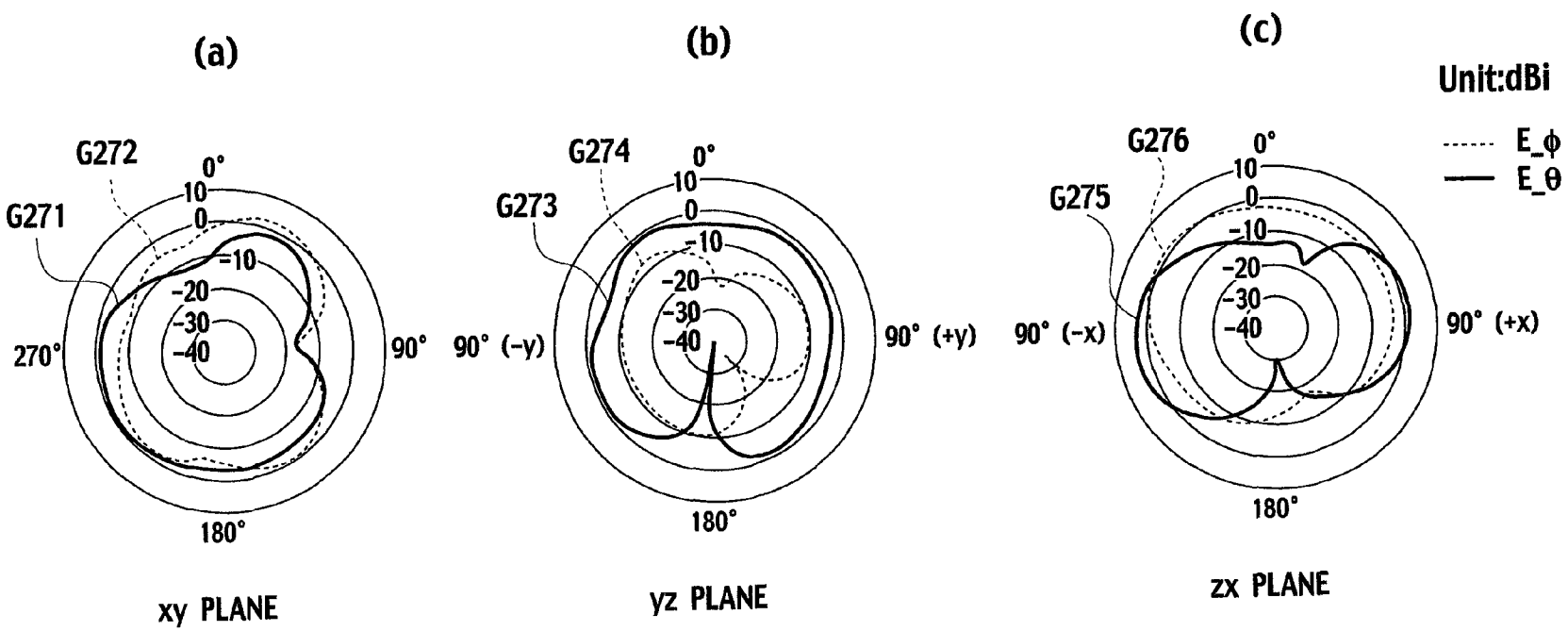
FIG. 27 is a view illustrating directivity of a main polarized wave ($E_\theta$) and directivity of a cross-polarization ($E_\phi$) of the antenna in a frequency of 2.43 GHz.

FIG. 27 is a view illustrating directivity of a main polarized wave (E_θ) and directivity of a cross-polarization (E_ϕ) of the antenna 1*c* in a frequency of 2.43 GHz.

Part (a) of FIG. 27 indicates directivity on an xy plane, a graph G271 in Part (a) of FIG. 27 indicates directivity of E_θ, and a graph G272 in Part (a) of FIG. 27 indicates directivity of E_ϕ. Part (b) of FIG. 27 indicates directivity on a yz plane, a graph G273 in Part (b) of FIG. 27 indicates directivity of E_θ, and a graph G274 in Part (b) of FIG. 27 indicates directivity of E_ϕ. Part (c) of FIG. 27 indicates directivity on a zx plane, a graph G275 in Part (c) of FIG. 27 indicates directivity of E_θ, and a graph G276 in Part (c) of FIG. 27 indicates directivity of E_ϕ.

It is understood from FIG. 27 that the antenna 1*c* has approximately favorable directivity. In sum, judging from the maximum gain, a gain of about −0.5 dBi is obtained.

Here, description will be given of a case in which a conductor is placed close to the antenna 1*c* as a mounting form of the antenna 1*c*.

Figure 31:
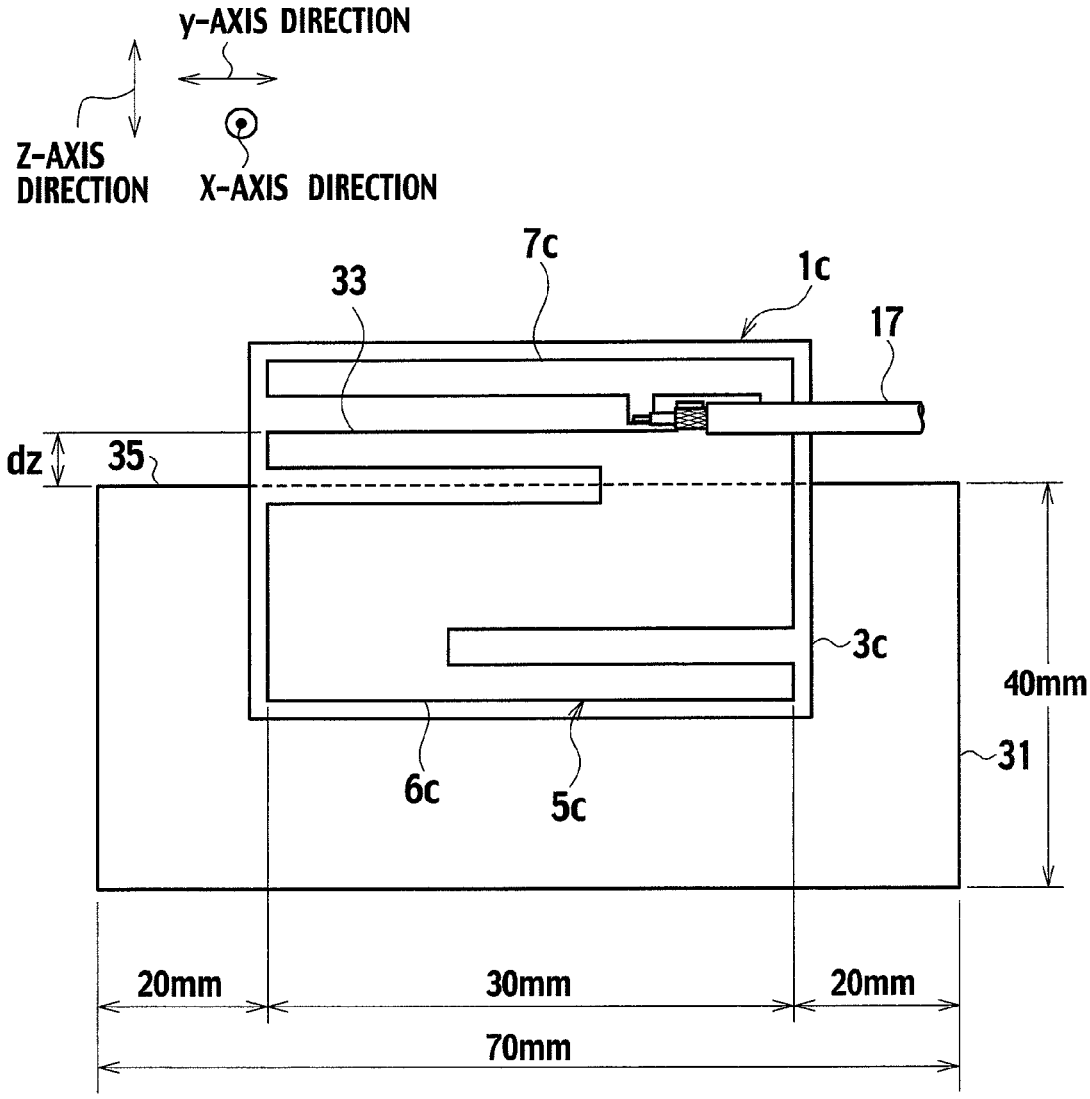
FIG. 31 is a view illustrating a state in which a flat plate-like conductive member is brought into contact with the plate-like antenna according to the fourth embodiment.

FIG. 31 is a view illustrating a state in which a flat plate-like conductive member (copper plate of, for example, 40 mm×70 mm×0.035 mm) 31 is brought into contact with the plate-like antenna 1*c*.

In a state that the copper plate 31 is thus placed, the thickness direction, the longitudinal direction and the width direction of each of the antenna 1*c* and the copper plate 31 match each other. Further, in the thickness direction, the flat plate-like copper plate 31 comes in contact with a back surface (surface where no conductor 5*c* is provided) of the antenna 1*c* (base 3*c*). In the longitudinal direction, the center of the copper plate 31 and that of the antenna 1*c* approximately match each other. In the width direction, the copper plate 31 is positioned on the other end portion side of the antenna 1*c* in the width direction, and a distance between one end portion 33 of the first conductor 6*c* of the antenna 1*c* in the width direction and one end portion 35 of the copper plate 31 in the width direction is dz.

Figure 32:
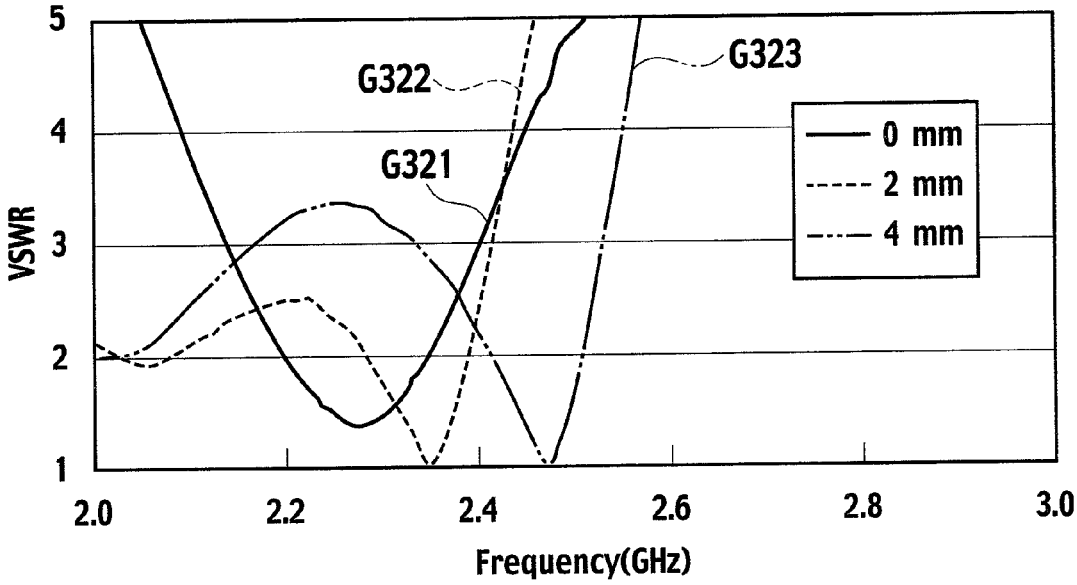
FIG. 32 is a view illustrating a frequency characteristic of the antenna at the time when a distance dz is changed.
Figure 32:
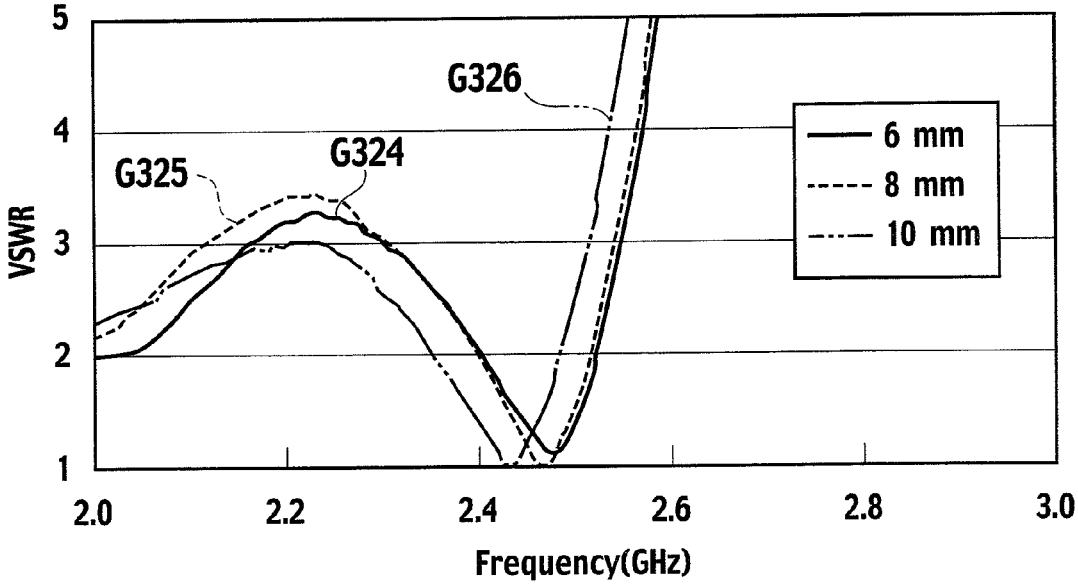

FIG. 32 is a view illustrating a frequency characteristic of the antenna 1*c* at the time when the distance dz is changed.

In Part (a) of FIG. 32, a graph G321 indicates a frequency characteristic at the time when dz=0 mm, a graph G322 indicates a frequency characteristic at the time when dz=2 mm, and a graph G323 indicates a frequency characteristic at the time when dz=4 mm.

Moreover, in Part (b) of FIG. 32, a graph G324 indicates a frequency characteristic at the time when dz=6 mm, a graph G325 indicates a frequency characteristic at the time when dz=8 mm, and a graph G326 indicates a frequency characteristic at the time when dz=10 mm.

Figure 33:
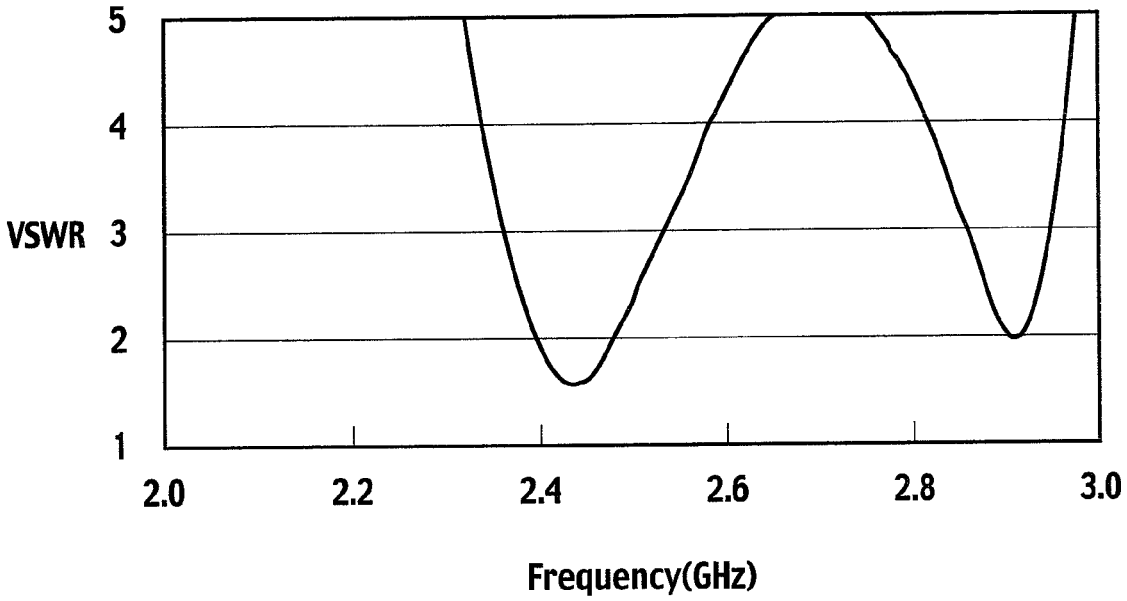
FIG. 33 is a view illustrating a frequency characteristic of the antenna after a length of a second conductor 7*c* and that of one end portion 33 are appropriately changed where dz=0 mm and frequency adjustment is performed.

FIG. 33 is a view illustrating a frequency characteristic of the antenna 1*c* after the length of the second conductor 7*c* and that of one end portion 33 are appropriately changed where dz=0 mm and then frequency adjustment is performed. In this state, in the antenna 1*c*, the range from 2.4 GHz to 2.4835 GHz corresponds to a resonance frequency band.

Figure 34:
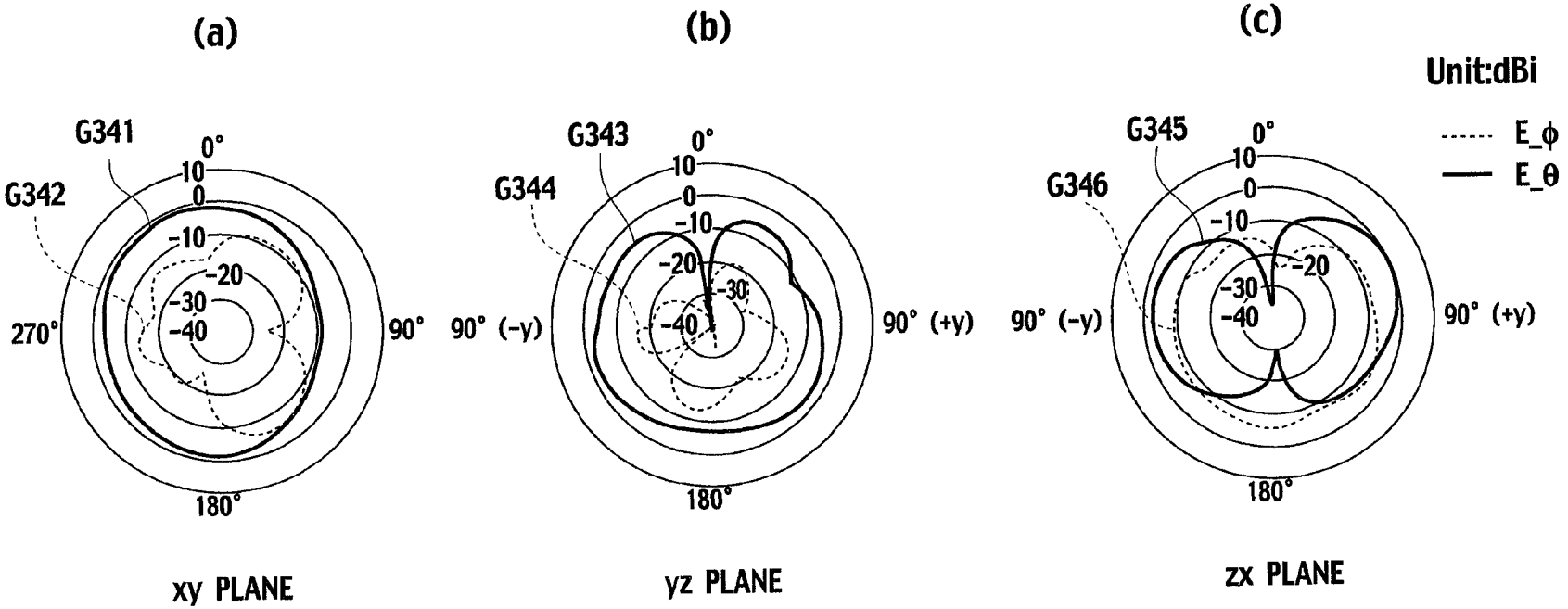
FIG. 34 is a view illustrating directivity of a main polarized wave (E_θ) and directivity of a cross-polarization (E_ϕ) of the antenna in a frequency of 2.43 GHz after the length of the second conductor 7*c* and that of one end portion 33 are appropriately changed where dz=0 mm and frequency adjustment is performed.

FIG. 34 is a view illustrating directivity of a main polarized wave (E_θ) and directivity of a cross-polarization (E_ϕ) of the antenna 1*c* at a frequency of 2.43 GHz after the length of the second conductor 7*c* and that of one end portion 33 are appropriately changed where dz=0 mm and then frequency adjustment is performed.

Part (a) of FIG. 34 indicates directivity on an xy plane, a graph G341 in Part (a) of FIG. 34 indicates directivity of E_θ, and a graph G342 in Part (a) of FIG. 34 indicates directivity of E_ϕ. Part (b) of FIG. 34 indicates directivity on a yz plane, a graph G343 in Part (b) of FIG. 34 indicates directivity of E_θ, and a graph G344 in Part (b) of FIG. 34 indicates directivity of E_ϕ. Part (c) of FIG. 34 indicates directivity on a zx plane, a graph G345 in Part (c) of FIG. 34 indicates directivity of E_θ, and a graph G346 in Part (c) of FIG. 34 indicates directivity of E_ϕ.

As is understood from FIG. 33 and FIG. 34, if frequency adjustment is performed, it is possible to obtain approximately favorable frequency characteristic and directivity even when the almost entire surface of the first conductor (ground conductor) 6*a* is covered with the conductor in a plan view (when seeing from an x-axis direction.) In other words, judging from the maximum gain, a gain of about −1 dBi is obtained.

Figure 35:
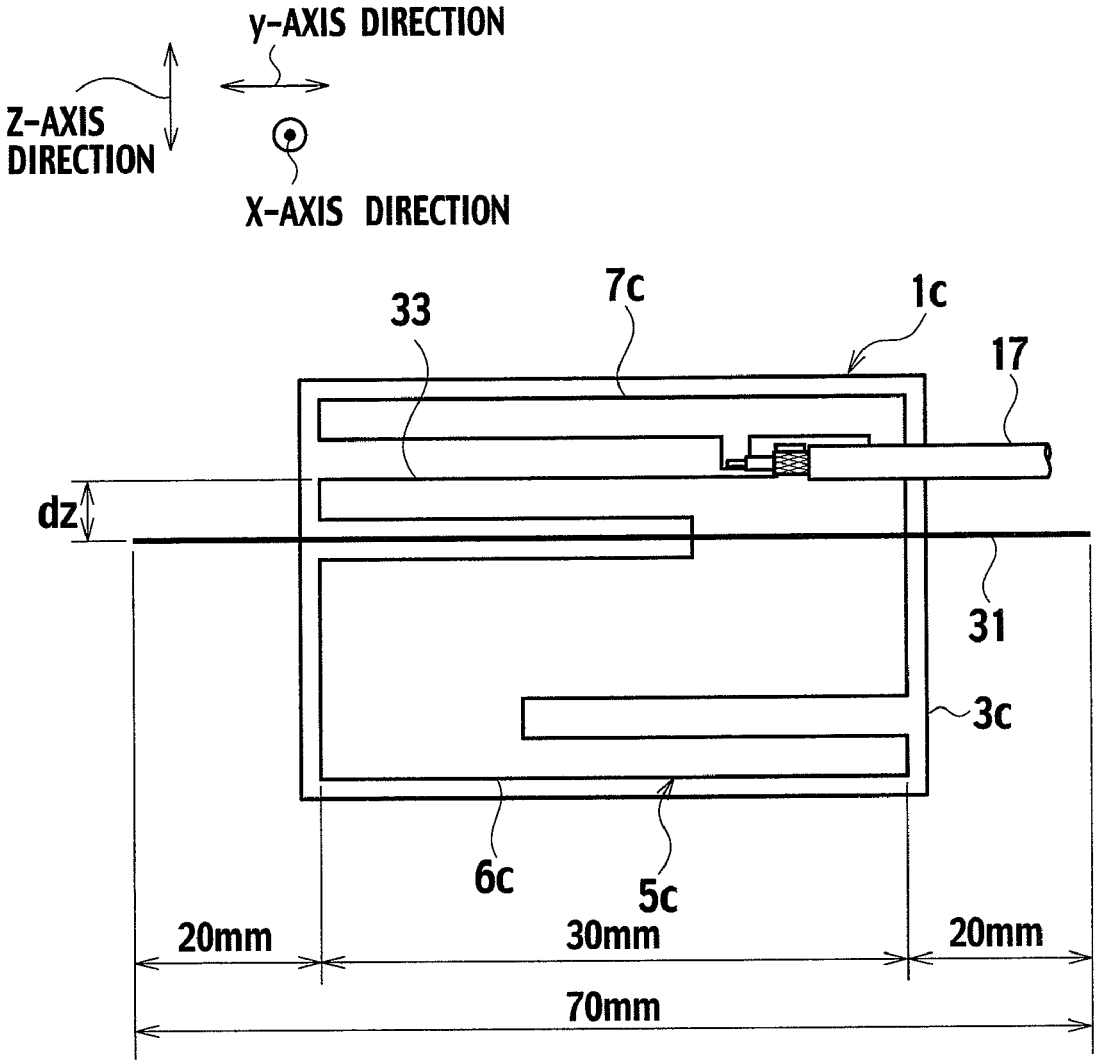
FIG. 35 is a view illustrating a state in which a flat plate-like conductive member is placed upright on the flat plate-like antenna.

FIG. 35 is a view illustrating a state in which a flat plate-like conductive member (copper plate of, for example, 40 mm×70 mm×0.035 mm) 31 is placed upright in the flat plate-like antenna 1*c*.

In the state that the copper plate 31 is thus mounted, the longitudinal directions of the antenna 1*c* and the copper plate 31 match each other and the center of the copper plate 31 and that of the antenna 1*c* approximately match each other. Further, the copper plate 31 is upright approximately perpendicular to the surface (surface where the conductor 5*c* is provided) of the antenna 1*c* (upright in a direction perpendicular to the paper plane of FIG. 35 and on the front side of the paper plane) and one end portion of the copper plate 31 in the width direction thereof comes in contact with the surface of the antenna 1*c*. Furthermore, a distance between the copper plate 31 and one end portion 33 of the first conductor 6*c* in the width direction is dz.

Figure 36:
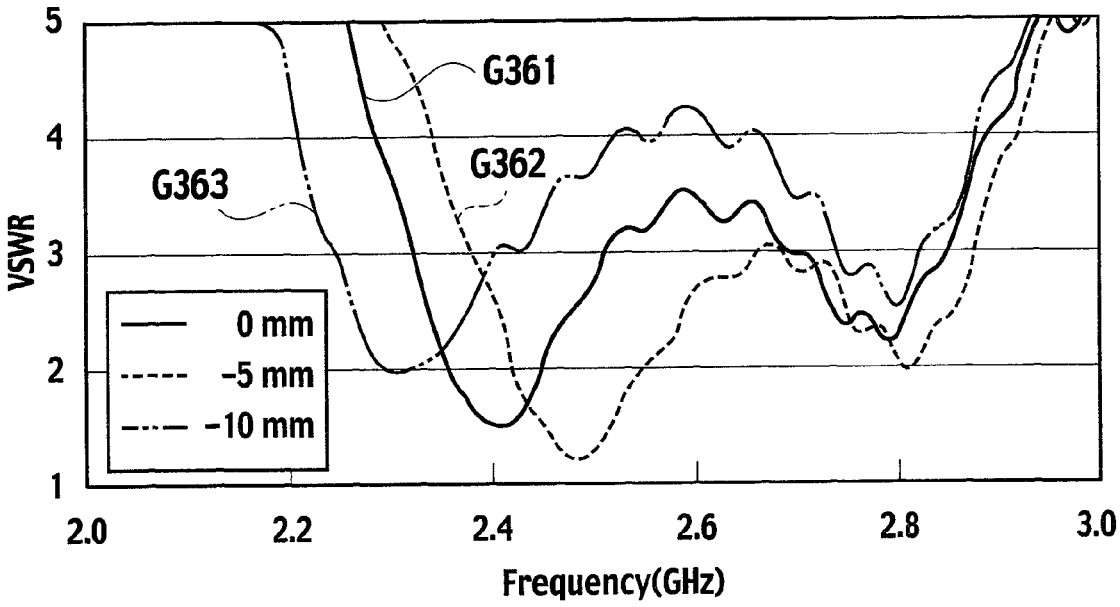
FIG. 36 is a view illustrating a frequency characteristic of the antenna at the time when the distance dz is changed.

FIG. 36 is a view illustrating a frequency characteristic of the antenna 1*c* at the time when the distance dz is changed.

In FIG. 36, a graph G361 indicates a frequency characteristic at the time when dz=0 mm, a graph G362 indicates a frequency characteristic at the time when dz=−5 mm, and a graph G363 indicates a frequency characteristic at the time when dz=−10 mm.

Figure 37:
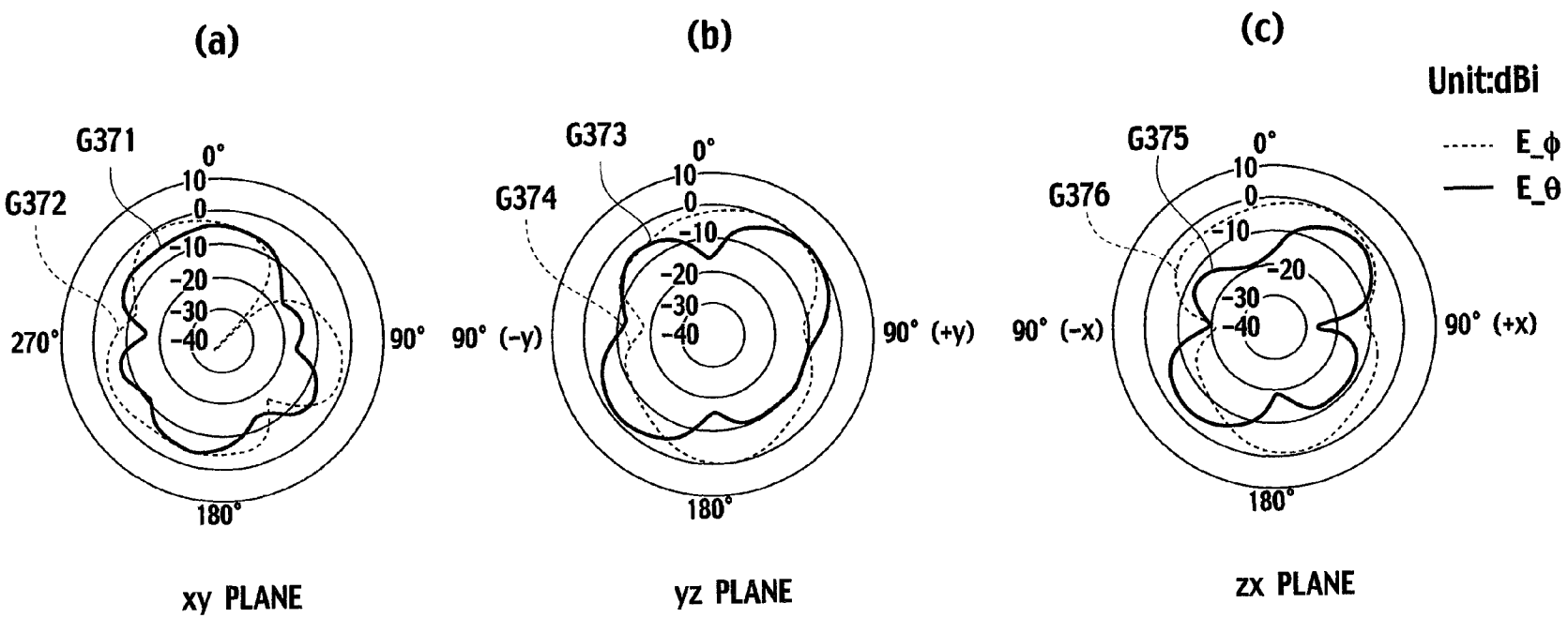
FIG. 37 is a view illustrating directivity of a main polarized wave (E_θ) and directivity of a cross-polarization (E_ϕ) of the antenna in a frequency of 2.43 GHz where dz=0 mm.

FIG. 37 is a view illustrating directivity of a main polarized wave (E_θ) and directivity of a cross-polarization (E_ϕ) of the antenna 1*c* in a frequency of 2.43 GHz where dz=0 mm.

Part (a) of FIG. 37 indicates directivity on an xy plane, a graph G371 in Part (a) of FIG. 37 indicates directivity of E_θ, and a graph G372 in Part (a) of FIG. 37 indicates directivity of E_ϕ. Part (b) of FIG. 37 indicates directivity on a yz plane, a graph G373 in Part (b) of FIG. 37 indicates directivity of E_θ, and a graph G374 in Part (b) of FIG. 37 indicates directivity of E_ϕ. Part (c) of FIG. 37 indicates directivity on a zx plane, a graph G375 in Part (c) of FIG. 37 indicates directivity of E_θ, and a graph G376 in Part (c) of FIG. 37 indicates directivity of E_ϕ.

It is understood from FIG. 36 and FIG. 37 that approximately favorable frequency and directivity can be obtained even when the copper plate 31 of the antenna 1*c* is placed upright.

Figure 38:
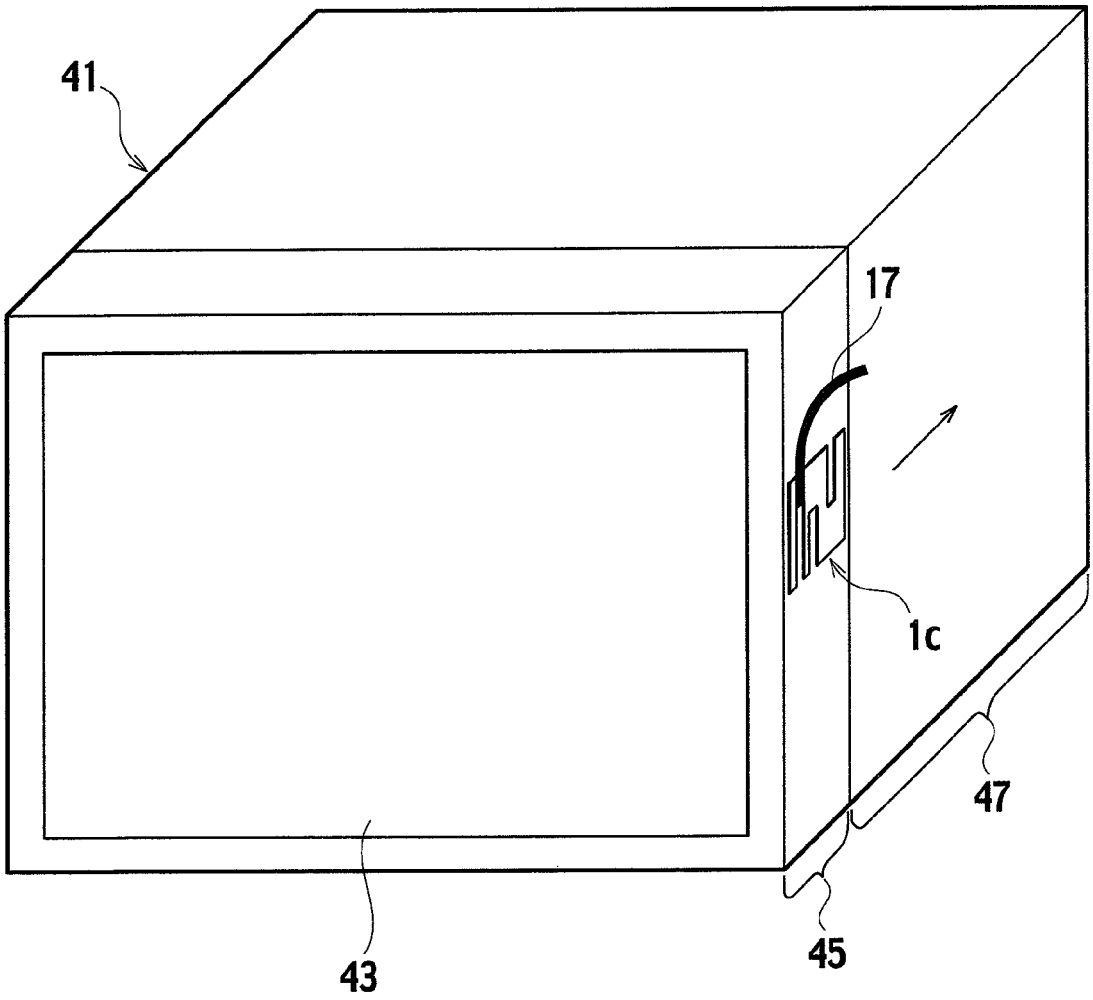
FIG. 38 is a view illustrating a state in which the antenna is mounted in an electronic apparatus.

FIG. 38 is a view illustrating a state in which the antenna 1*c* is mounted in an electronic apparatus (for example, a display device of a car navigation system).

A display device 41 of the car navigation system includes an image display section 43 formed of a LCD or the like, a frame body 45 which is provided around the image display section 43 and has a rectangular outer shape, and a housing 47 which has a rectangular outer shape and stores inside a drive circuit or the like of the image display section 43 and is provided on the inner sides of the image display section 43 and the frame body 45 to be integral with the frame body 45. Note that the frame body 45 is made of an insulating material and the housing 47 is made of a conductor such as a copper plate.

In a state that the antenna 1*c* is mounted on an circumference of the frame body 45 as illustrated in FIG. 38, the antenna 1*c* is separated away from the housing 47, but the mounting position of the antenna 1*c* may be moved to the housing 47 side as illustrated by an arrow in FIG. 38. Even when such movement is made, it is possible to obtain favorable frequency characteristic and directivity as illustrated in FIG. 33 and FIG. 34 and improve a degree of freedom of the mounting form of the antenna 1*c*.

Moreover, the antenna 1*c* may be mounted so as to be bent at an angle of 90° across the corner part of the frame body 45.

Fifth Embodiment

Figure 28:
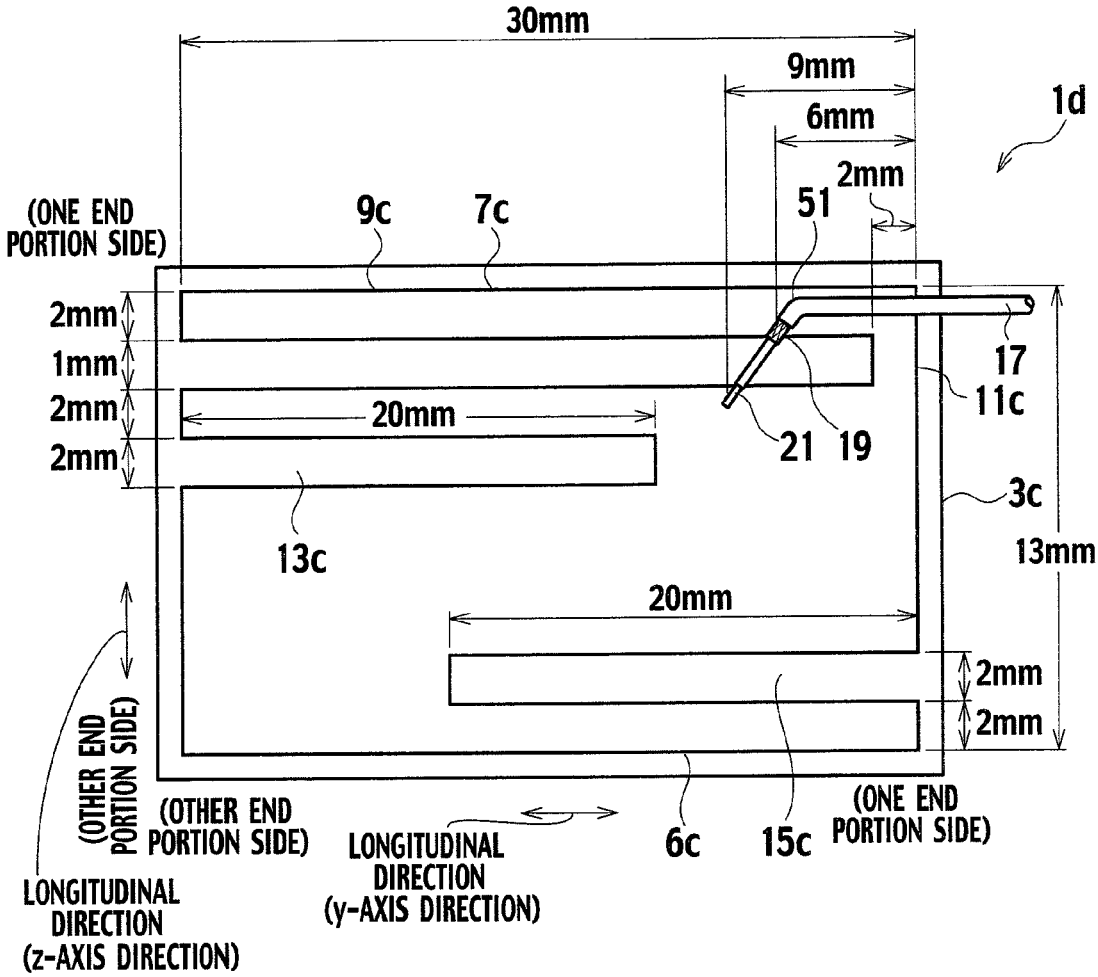
FIG. 28 is a view illustrating a schematic configuration of an antenna according to a fifth embodiment of the present invention.

FIG. 28 is a view illustrating a schematic configuration of an antenna 1*d* according to a fifth embodiment of the present invention.

The antenna 1*d* according to the fifth embodiment of the present invention is different from the antenna 1*c* according to the fourth embodiment in the points that the connection sections 25 and 27 are deleted and the end portion of the coaxial cable 17 (portion of the end portion side where the inner conductor 21 and the outer conductor 19 are electrically connected to the antenna 1*d*) is obliquely placed, but regarding the other points, the antenna 1*d* is configured in approximately the same way as that of the antenna 1*c* of the fourth embodiment.

In other words, the antenna 1*d* according to the fifth embodiment of the present invention is configured to include the base 3*c*, the first conductor 6*c*, the second conductor 7*c*, and the coaxial cable 17.

The inner conductor 21 of the coaxial cable 17 is electrically connected to a first predetermined portion of the first conductor 6*c* and the outer conductor 19 is electrically connected to a second predetermined portion of the second conductor 7*c*.

The first predetermined portion where the inner conductor 21 of the coaxial cable 17 is connected is located at a side of one end portion of the first conductor 6*c* in a width direction, and at a side of the one end portion of the first conductor 6*c* in a longitudinal direction. Further, the second predetermined portion where the outer conductor 19 of the coaxial cable 17 is connected is located between the first predetermined portion and the second element 11*c* of the second conductor 7*c* at a side of one end portion of the first element 9*c* of the second conductor 7*c* in a longitudinal direction. Furthermore, the second predetermined portion is positioned on the first conductor 6*c* side (lower side of the first element 9*c* in FIG. 28) in a width direction of the first element 9*c*.

In addition, the coaxial cable 17 is obliquely provided between the first portion and the second portion, but is bent afterward and thereby extends to a side of the one end portion of the first conductor 6*c* (side where the second element 11*c* is provided; right side in FIG. 28) in the longitudinal direction. Moreover, the coaxial cable 17 is bent, and therefore a portion 51 in the vicinity of the outer conductor 19 of the coaxial cable 17 (portion opposite to the center conductor 21 with the outer conductor 19 disposed in-between) is fixed to an insulating film 23 (base 3*c*) of the antenna 1*d* by adhesion, for example. Further, the coaxial cable 17 may be obliquely extended without being bent.

Furthermore, in the antenna 1*d*, the mounting form of the coaxial cable 17 may be reversely set as in the case of the antenna 1*c* according to the fourth embodiment.

A test result of the characteristics of the antenna 1*d* will be next described.

Figure 29:
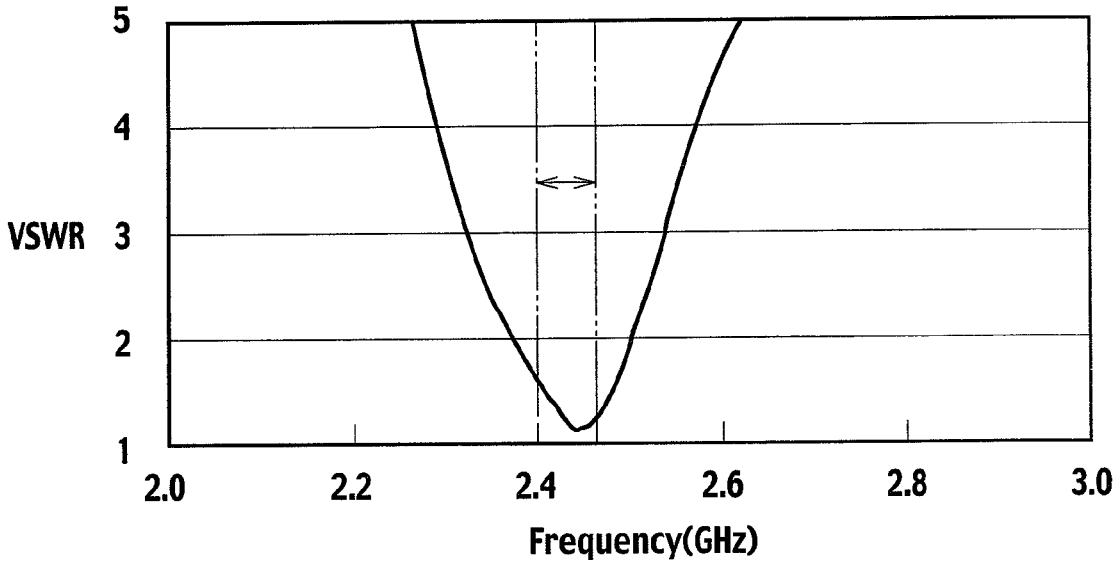
FIG. 29 is a view illustrating a frequency characteristic of the antenna

FIG. 29 is a view illustrating a frequency characteristic of the antenna 1*d*.

As is understood from FIG. 29, in the antenna 1*d*, the range from 2.4 GHz to 2.4835 GHz (range illustrated by an arrow in FIG. 29) corresponds to a resonance frequency band.

Figure 30:
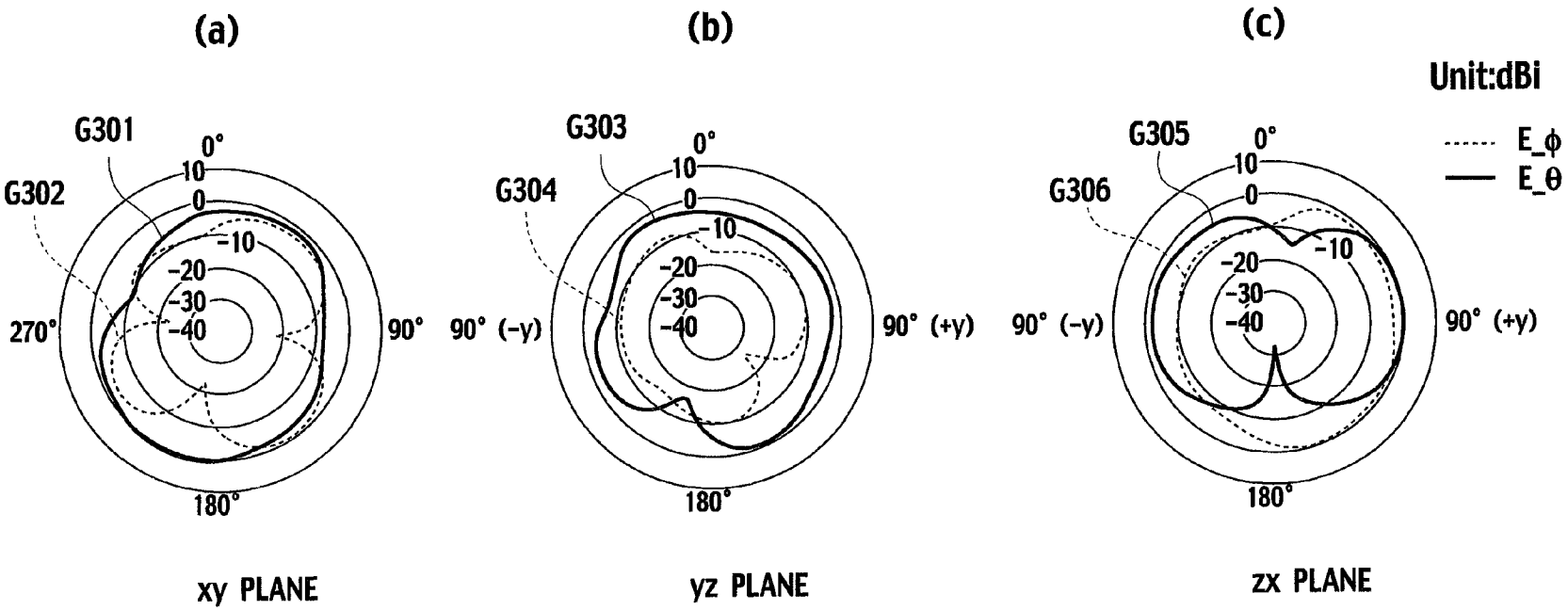
FIG. 30 is a view illustrating directivity of a main polarized wave (E_θ) and directivity of a cross-polarization (E_ϕ) in connection with the antenna in a frequency of 2.43 GHz.

FIG. 30 is a view illustrating directivity of a main polarized wave (E_θ) and directivity of a cross-polarization (E_ϕ) of the antenna 1*c* at a frequency of 2.43 GHz where dz=0 mm.

Part (a) of FIG. 30 indicates directivity on an xy plane, a graph G301 in Part (a) of FIG. 30 indicates directivity of E_θ, and a graph G302 in Part (a) of FIG. 30 indicates directivity of E_ϕ. Part (b) of FIG. 30 indicates directivity on a yz plane, a graph G303 in Part (b) of FIG. 30 indicates directivity of E_θ, and a graph G304 in Part (b) of FIG. 30 indicates directivity of E_ϕ. Part (c) of FIG. 30 indicates directivity on a zx plane, a graph G305 in Part (c) of FIG. 30 indicates directivity of E_θ, and a graph G306 in Part (c) of FIG. 30 indicates directivity of E_ϕ.

It is understood from FIG. 30 that the antenna 1*d* has approximately favorable directivity.

Meanwhile, in the antenna 1 according to the first embodiment illustrated in FIG. 1, the mounting form of the coaxial cable 17 may be reversely set. Specifically, the inner conductor 21 may be connected to the portion where the outer conductor 19 is connected, and the outer conductor 19 is connected to the portion where the inner conductor 21 is connected so that the coaxial cable 17 can be extended upward in FIG. 1.

Further, the antenna 1*c* according to the third embodiment and the antenna 1*d* according to the fourth embodiment may be used by being bent and mounted as illustrated in FIG. 2 and FIG. 16.

Furthermore, in the antenna 1 according to the first embodiment, the antenna 1*a* according to the second embodiment and the antenna 1*b* according to the third embodiment, the mounting form of the coaxial cable 17 may be changed as in the antenna 1*c* according to the third embodiment and the antenna 1*d* according to the fourth embodiment.

The invention claimed is:

1. An antenna comprising:

a plate-like base made of an insulating material and having flexibility;

a first conductor formed into an approximately rectangular outer shape, and provided on a surface of the base, the first conductor having a first cut-out portion and a second cut-out portion;

a second conductor having a first element and a second element provided so as to connect the first element and the first conductor to each other, the first element being formed in a long narrow rectangular shape with approximately the same length as that of the first conductor, the first element being provided on the base a predetermined distance away from the first conductor, at a side of one end portion of the first conductor in a width direction, in such a way that a longitudinal direction of the first element is aligned with a longitudinal direction of the first conductor, the second element having a short rectangular shape, and being provided on the surface of the base so as to extend from one end portion of the first element in a longitudinal direction toward a vicinity thereof between the first element and the first conductor; and a coaxial cable whose outer conductor is electrically connected to a first predetermined portion of the first conductor and whose inner conductor is electrically connected to a second predetermined portion of the second conductor;

wherein the first predetermined portion where the outer conductor of the coaxial cable is connected extends from the one end portion of the first conductor in the width direction to a vicinity thereof, at the side of the one end portion of the first conductor in the longitudinal direction thereof;

the second predetermined portion where the inner conductor of the coaxial cable is connected extends in the width direction of the first element, at a side of the one end portion of the first element of the second conductor in the longitudinal direction;

the first cut-out portion is formed into a long narrow rectangular shape with approximately the same width as that of the first element of the second conductor, and extends to an approximately center portion of the first conductor from the other end portion of the first conductor in the longitudinal direction, at the side of the one end portion of the first conductor in the width direction, in such a way that a longitudinal direction of the first cut-out portion is aligned with the longitudinal direction of the first conductor; and the second cut-out portion is formed into a long narrow rectangular shape with approximately the same width as that of the first element of the second conductor, and extends to an approximately center portion of the first conductor from the one end portion of the first conductor in the longitudinal direction, at a side of the other end portion of the first conductor in the width direction in such a way that a longitudinal direction of the second cut-out portion is aligned with the longitudinal direction of the first conductor;

or alternatively, wherein the first cut-out portion is formed into a long narrow rectangular shape with approximately the same width as that of the first element of the second conductor, and extends to an approximately center portion of the first conductor from the one end portion of the first conductor in the longitudinal direction, at the side of the one end portion of the first conductor in the width direction, in such a way that the longitudinal direction of the first cut-out portion is aligned with the longitudinal direction of the first conductor; and the second cut-out portion is formed into a long narrow rectangular shape with approximately the same width as that of the first element of the second conductor, and extends to an approximately center portion of the first conductor from the other end portion of the first conductor in the longitudinal direction, at a side of the other end portion of the first conductor in the width direction in such a way that the longitudinal direction of the second cut-out portion is aligned with the longitudinal direction of the first conductor.

2. An antenna comprising:

a plate-like base made of an insulating material and having flexibility;

a first conductor formed into an approximately rectangular outer shape, and provided on a surface of the base , the first conductor having a first cut-out portion and a second cut-out portion;

a second conductor having a first element and a second element provided so as to connect the first element and the first conductor to each other, the first element being formed in a long narrow rectangular shape with approximately the same length as that of the first conductor, the first element being provided on the base a predetermined distance away from the first conductor, at a side of one end portion of the first conductor in a width direction, in such a way that a longitudinal direction of the first element is aligned with a longitudinal direction of the first conductor, the second element having a short rectangular shape, and being provided on the surface of the base so as to extend from one end portion of the first element in a longitudinal direction toward a vicinity thereof between the first element and the first conductor; and a coaxial cable whose outer conductor is electrically connected to a first predetermined portion of the first conductor and whose inner conductor is electrically connected to a second predetermined portion of the second conductor;

wherein the first predetermined portion where the outer conductor of the coaxial cable is connected extends from the one end portion of the first conductor in the longitudinal direction thereof to a vicinity thereof, at the side of the one end portion of the first conductor in the longitudinal direction thereof;

the second predetermined portion where the inner conductor of the coaxial cable is connected extends in a width direction of the first element, at a side of the one end portion of the first element of the second conductor in the longitudinal direction of the first element;

the first cut-out portion is formed into a long narrow rectangular shape with approximately the same width as that of the first element of the second conductor, and extends to a portion on the side of the one end portion of the first conductor in the longitudinal direction from the other end portion of the first conductor in the longitudinal direction, at the side of the one end portion of the first conductor in the width direction, in such a way that the longitudinal direction of the first cut-out portion is aligned with the longitudinal direction of the first conductor; and the second cut-out portion is formed into a long narrow rectangular shape with approximately the same width as that of the first element of the second conductor, and extends to a portion on the side of the other end portion of the first conductor in the longitudinal direction from the one end portion of the first conductor in the longitudinal direction, at a side of the other end portion of the first conductor in the width direction in such a way that the longitudinal direction of the second cut-out portion is aligned with the longitudinal direction of the first conductor.

3. An antenna comprising:

a plate-like base made of an insulating material and having flexibility;

a first conductor formed into an approximately rectangular outer shape, and provided on a surface of the base , the first conductor having a first cut-out portion and a second cut-out portion;

a second conductor having a first element and a second element provided so as to connect the first element and the first conductor to each other, the first element being formed in a long narrow rectangular shape with approximately the same length as that of the first conductor, the first element being provided on the base a predetermined distance away from the first conductor, at a side of one end portion of the first conductor in a width direction, in such a way that a longitudinal direction of the first element is aligned with a longitudinal direction of the first conductor, the second element having a short rectangular shape, and being provided on the surface of the base so as to extend from one end portion of the first element in a longitudinal direction toward a vicinity thereof between the first element and the first conductor;

a first connection section formed into a rectangular shape, and provided on the surface of the base to be connected to the first element, the first connection section being located, in the width direction of the first conductor, at the side of the first element of the second conductor between the first conductor and the first element, and being located, in the longitudinal direction of the first conductor, at the side of the second element of the second conductor;

a second connection section formed into a rectangular shape, and provided on the surface of the base to be connected to the first conductor, the second connection section being located, in the width direction of the first conductor, at the side of the first conductor between the first conductor and the first element of the second conductor, and being located, in the longitudinal direction of the first conductor, between the first connection section and the second element of the second conductor; and a coaxial cable whose inner conductor is electrically connected to the first connection section and whose outer conductor is electrically connected to the second connection section;

wherein the first cut-out portion is formed into a long narrow rectangular shape with approximately the same width as that of the first element of the second conductor, and extends to a portion on the side of the one end portion of the first conductor in the longitudinal direction from the other end portion of the first conductor in the longitudinal direction, at the side of the one end portion of the first conductor in the width direction, in such a way that the longitudinal direction of the first cut-out portion is aligned with the longitudinal direction of the first conductor; and the second cut-out portion is formed into a long narrow rectangular shape with approximately the same width as that of the first element of the second conductor, and extends to a portion on the side of the other end portion of the first conductor in the longitudinal direction from the one end portion of the first conductor in the longitudinal direction, at a side of the other end portion of the first conductor in the width direction in such a way that the longitudinal direction of the second cut-out portion is aligned with the longitudinal direction of the first conductor.

4. An antenna comprising:

a plate-like base made of an insulating material and having flexibility;

a first conductor formed into an approximately rectangular outer shape, and provided on a surface of the base , the first conductor having a first cut-out portion and a second cut-out portion;

a second conductor having a first element and a second element provided so as to connect the first element and the first conductor to each other, the first element being formed in a long narrow rectangular shape with approximately the same length as that of the first conductor, the first element being provided on the base a predetermined distance away from the first conductor, at a side of one end portion of the first conductor in a width direction, in such a way that a longitudinal direction of the first element is aligned with a longitudinal direction of the first conductor, the second element having a short rectangular shape, and being provided on the surface of the base so as to extend from one end portion of the first element in a longitudinal direction toward a vicinity thereof between the first element and the first conductor; and a coaxial cable whose inner conductor is electrically connected to a first predetermined portion of the first conductor and whose outer conductor is electrically connected to a second predetermined portion of the second conductor;

wherein the first predetermined portion where the inner conductor of the coaxial cable is connected is located at a side of the one end portion of the first conductor in the width direction and at a side of the one end portion of the first conductor in the longitudinal direction;

the second predetermined portion where the outer conductor of the coaxial cable is connected is located between the first predetermined portion and the second element of the second conductor, at a side of the one end portion of the first element of the second conductor in the longitudinal direction;

the first cut-out portion is formed into a long narrow rectangular shape with approximately the same width as that of the first element of the second conductor, and extends to a portion on the side of the one end portion of the first conductor in the longitudinal direction from the other end portion of the first conductor in the longitudinal direction, at the side of the one end portion of the first conductor in the width direction, in such a way that the longitudinal direction of the first cut-out portion is aligned with the longitudinal direction of the first conductor; and the second cut-out portion is formed into a long narrow rectangular shape with approximately the same width as that of the first element of the second conductor, and extends to a portion on the side of the other end portion of the first conductor in the longitudinal direction from the one end portion of the first conductor in the longitudinal direction, at a side of the other end portion of the first conductor in the width direction in such a way that the longitudinal direction of the second cut-out portion is aligned with the longitudinal direction of the first conductor.

* * * * *